US006477865B1

(12) United States Patent
Matsumoto

(10) Patent No.: US 6,477,865 B1
(45) Date of Patent: Nov. 12, 2002

(54) THREE-DIMENSIONAL MARQUISETTE STYLE KNITTED FABRIC

(75) Inventor: Koichi Matsumoto, Fukui (JP)

(73) Assignee: Asahi Doken Kabushiki Kaisha, Fukui (JP)

( * ) Notice: Subject to any disclaimer, the term of this patent is extended or adjusted under 35 U.S.C. 154(b) by 0 days.

(21) Appl. No.: 09/913,660

(22) PCT Filed: Dec. 18, 2000

(86) PCT No.: PCT/JP00/08966

§ 371 (c)(1),
(2), (4) Date: Oct. 9, 2001

(87) PCT Pub. No.: WO01/44551

PCT Pub. Date: Jun. 21, 2001

(30) Foreign Application Priority Data

Dec. 16, 1999 (JP) ..... 11-358065

(51) Int. Cl.[7] ..... D04B 21/10
(52) U.S. Cl. ..... 66/195; 66/196
(58) Field of Search ..... 66/195, 192, 193, 66/196; 42/50, 312, 1

(56) References Cited

U.S. PATENT DOCUMENTS

| | | | | | |
|---|---|---|---|---|---|
| 4,074,543 | A | | 2/1978 | Schmidt | |
| D265,769 | S | * | 8/1982 | Stocker | 66/195 |
| 4,787,219 | A | * | 11/1988 | Sato et al. | 66/195 |
| 5,385,036 | A | * | 1/1995 | Spillane et al. | 66/191 |
| 5,896,758 | A | * | 4/1999 | Rock et al. | 66/191 |
| 6,105,401 | A | * | 8/2000 | Chaderon et al. | 66/191 |
| 6,196,032 | B1 | * | 3/2001 | Rock et al. | 66/191 |
| 6,314,768 | B2 | * | 11/2001 | Motoya | 66/195 |

FOREIGN PATENT DOCUMENTS

| | | |
|---|---|---|
| JP | 42058/1988 | 3/1988 |
| JP | 42195/1988 | 3/1988 |
| JP | 65892/1989 | 4/1989 |
| JP | 1-250454 | 10/1989 |
| JP | 11-152663 | 6/1999 |

* cited by examiner

*Primary Examiner*—Danny Worrell
(74) *Attorney, Agent, or Firm*—Jordan and Hamburg LLP

(57) ABSTRACT

The invention is aimed to provide a three-dimensional marquisette-like knitted fabric, that is good in air retainability, air and water conductibility, light transmittance, as well as dimensional stability and shape retainability in the knitting and knitting-width directions, and in linearity; and has unevenness and slippage preventing property on its surface, thus being suitable in various uses. To this end, a three-dimensional marquisette-like structure is made as follows. A double-web knitted fabric is made by warp knitting, and is preferably comprised of the front and back mesh webs (1, 2) and connecting yarns (3) passed between the mesh webs alternately. At least one of the mesh webs (1, 2) has a marquisette-like construction formed by the rows of chain stitches (11, 21) and inlay yarn (5). In addition, connecting yarns (3) for connecting the mesh webs (1, 2) is shifted knitting-width-wise by at least one wale to be passed as slanted at every required course position corresponding to the marquisette-like construction of at least one of the mesh webs.

20 Claims, 17 Drawing Sheets

THREE-DIMENSIONAL MARQUISETTE STYLE KNITTED FABRIC

TECHNICAL FIELD

The present invention relates to a three-dimensional marquisette-like knitted fabric that is formed of double web and has good dimensional stability in knitting and widthwise directions.

BACKGROUND ART

Conventionally, a mesh fabric formed of quadrangular mesh openings, that is, the marquisette-like knitted fabric has been formed by single-web weft knitting. The single-web knitted fabric is poor in thickness-wise dimensional stability and in bulkiness despite of mesh structure. Thus, the single-web knitted fabric has limited uses and is not suitable in the field of use where the thickness or three-dimensional structure is required.

Meanwhile, three-dimensional nets having three-dimensional spaces at mesh openings are proposed which are comprised of; front and back mesh webs; and connecting yarns that are alternately passed between the front and back mesh webs in a manner the front and back mesh webs are connected together. Among them are three-dimensional nets proposed by the applicant of the present invention. In the proposed three-dimensional nets, compressive strength and shape retainability are particularly improved (for example, Japanese Granted Patent Nos. 2,547,693 and 2,762,052).

In the proposed three-dimensional nets, the three-dimensional mesh spaces are defined by cord portions that have in themselves open spaces air and water conductible. Thus, the proposed three-dimensional nets are good in air conductibility and water conductibility. Nevertheless, the front and back mesh webs are formed by joining the braids continuing in the knitting direction with the braids adjoining on the right and left sides alternately.

Therefore, the three-dimensional net mentioned above requires some treatment for spread-widening of the three-dimensional mesh spaces, such as heat setting after knitting that is applied while the net is expanded both in the knitting and widthwise directions. Moreover, when the net is applied with tension in knitting direction, the three-dimensional mesh spaces are elongated in the knitting direction and narrowed in a knitting width direction, although the net has good compressive strength. This is because of such net structure the braids formed of one or a plurality of wales continuing in the knitting direction are joined with the adjoining braids on the right and left sides alternately.

Hence, the proposed three-dimensional net has poor dimensional stability in knitting and widthwise directions. Therefore, some reinforcer must be accompanied in a use where tensile strength and the dimensional stability both in the knitting and widthwise directions are required.

In addition, front and back surfaces of the three-dimensional net are formed of the planar braids on the front and back mesh webs, which have little unevenness if anything, and are relatively slippery. Therefore, in some application of the three-dimensional nets, the nets have to be laminated or composited with non-slippery or rough-surfaced materials.

In view of the above, the present invention is to provide a three-dimensional marquisette-like knitted fabric having following advantages—good dimensional stability and shape reatainability in the knitting and widthwise directions despite of three-dimensional mesh structure; sufficient tensile strength in the knitting and widthwise directions; good linearities in mechanical properties; as well as other features such as air retainability, air conductibility, water conductibility, optical transmittance, transparency and bulkiness. The present invention is also to provide a three-dimensional marquisette-like knitted fabric having features related to double-layered or triple layered structure that is for example formed of natural fabric and synthetic fabric; and having unevenness on the surfaces such as to prevent slippage; thereby being suitable for variety of applications due to such features.

DISCLOSURE OF THE INVENTION

A three-dimensional marquisette-like knitted fabric made by warp knitting as a double-web knitted fabric and comprising: front and back mesh webs; and connecting yarns passed alternately between the mesh webs, at least one of said mesh webs being knitted as a marquisette-like structure comprised of; stitch rows of chain stitches; and inlay yarns knitting-width-wise inlayed rightward and leftward alternately into the stitch row. In other words, the invention encompasses; the knitting fabric in which both of the front and back mesh webs has a marquisette-like construction; and the knitted fabric in which one of the mesh webs has a marquisette-like g construction and another one of the mesh webs has a net construction or a mesh construction or the like.

The marquisette-like mesh webs may be fabricated as follows: shifting inlay yarn that constitute the mesh web traverse-wise by at least one wale at the required course position in the knitting direction to form quadrangular mesh openings as in so-called marquisette construction; in otherwise, by shifting the stitch rows traverse-wise by at least one wale at the required course position in the knitting direction to form mesh openings into a quadrangular shape. In such a case, the inlay yarn is recommended to be inlayed traverse-wise corresponding to the shifting of the stitch row.

The above-mentioned marquisette-like structure or construction may not be limited to the above marquisette construction, but fabrics using the marquisette construction as a base construction and applied with variations or modifications, or other fabrics made by quadrangular mesh openings or the like as a base structure and having an appearance of marquisette-like may be used.

Since the three-dimensional marquisette-like knitted fabric of structures mentioned above according to the present invention has a three-dimensional net structure with quadrangular mesh openings on at least one of the front and back surfaces, it is high in void content, light in weight, and superior in air conductibility or water conductibility. In addition to it, since at least one of the front and back mesh webs is formed into so called marquisette-like structure in which the mesh openings mainly assume a quadrangular shape by the stitch row and inlay yarn, it is moderately resilient and tough; and thus even when the other surface has other net structures of honeycomb or rhombic shape, it has significant tensile strength in the knitting and widthwise directions, is superior in dimensional stability in the knitting and widthwise directions; and shape retainability can be preferably maintained. Especially when the front and back mesh webs are marquisette-like knitting construction, the dimensional stability in the knitting and widthwise directions can be maintained further preferably; and simultaneously the knitted fabric being resilient and having body may be obtained.

The above-mentioned three-dimensional marquisette-like knitted fabric may be fabricated in such a manner that;

connecting yarns connecting the front and back mesh webs are shifted traverse-wise by at least one wale and passed as inclined at every required course position according to the marquisette-like structure or a net structure such as honeycombed, of the front and backmesh webs; thus pass-between portions of the connecting yarns are formed into a marquisette-like structure.

In this case, since a three-dimensional marquisette-like structure is formed at between the front and back mesh webs, the surrounding portion, of the connecting yarn, defining the three-dimensional quadrangular mesh openings includes inclined-wise extending connecting yarns not only at the portion in the knitting direction along the stitch row, but also at the portion in the knitting-width direction; and thus the entire surrounding portion forms a wall; thereby being superior in shape retainability and compressive strength of the entire knitted fabric.

It is particularly preferable when the connecting yarns are shifting traverse-wise at every course position corresponding to marquisette-like knitting construction of at least one of the front and back mesh webs and fabricated into a marquisette-like structure corresponding to the marquisette-like knitting construction of the mesh webs. In other words, it is further superior in overall shape retainability or compressive strength, and further, in permeability owing to the mesh openings assuming a quadrangular shape, especially air conductibility, water conductibility and light transmittance in the direction approximately right angle with respect to the surface of the fabric can be preferably maintained; and on the other hand, light-shielding effect and hiding power in the inclined direction increase.

In the above-mentioned three-dimensional marquisette knitted fabric, since connecting yarns for connecting the front and back mesh webs are shifted at a part of or all the required course positions, from first wale of one of the mesh webs to the wale of the other one that is shifted by at least one wale rightward or leftward from the second wale matching the first wale and passed in the inclined direction; the pass-between portions of the connecting yarns can be constructed so as to be inclined rightward and leftward alternately and/or intersected in X-form in a staggered manner.

In this case, inside of the quadrangular mesh openings at all or discretional portions of at least one of the front and back marquisette-like knitting construction, there are inclined-wise pass-between portions of the connecting yarns. Therefore, the portion extending in the knitting direction among the surrounding or defining portions of the mesh openings can be prevented from collapsing in the knitting-width direction; thereby improving the dimensional stability in the knitting and widthwise directions, increasing shape retainability, compressive strength and stability in thickness of the entire knitted fabric, and exhibiting good filtering effect.

In addition, when the connecting yarn is passed inclined-wise as mentioned above, it is possible to construct the fabric in such a manner that; at least at a part of the front and back mesh webs, there is no portion in which the connecting yarn is passed at a right angle between the front and back mesh webs; or that no connecting yarn is passed between the stitch rows on the inter-web-wise opposed wales on the front and back mesh webs. It is also possible to pass the connecting yarns every few courses inclined-wise so that the portion in which the connecting yarns are passed at a right angle with respect to the right and left mesh webs and the portion in which the connecting yarn is passed inclined-wise with respect thereto are mixed. The position where the connecting yarn is passed in the inclined direction can be determined arbitrary.

In the present invention, a three-dimensional marquisette-like knitted fabric mentioned above may be constructed in such a manner that some of the stitch rows on at least one of the front and back mesh webs are not connected by the connecting yarn. In this case, the internal space increases and air conductibility, water conductibility, and light transmittance can be preferably maintained.

In addition, at least one of the front and back mesh webs may also be constructed in such a manner that; the stitch row of every other wale or every few wales are not connected by the connecting yarn at an entire course or an arbitrary positions of the course; so that the stitch rows connected by the connecting yarn and the stitch rows not connected by the connecting yarn are mixed.

As mentioned above, by constructing the fabric without passing the connecting yarn between the stitch rows of the inter-web-wise opposed wales on the front and back sides, the amount of consumption of the yarn of mesh web is well balanced, thereby improving knitting property.

In addition, light transmittance, moisture permeability, air conductibility, and water conductibility are improved, dimensional stability is not impaired, and economical efficiency is ensured.

Other aspect of invention-wise three-dimensional marquisette-like knitted fabrics comprising: front and back mesh webs; and yarns forming stitches on both of the mesh webs and in same time being passed alternately between the mesh webs as to connect the mesh webs, at least one of said mesh webs being knitted as a marquisette-like structure comprised of; stitch rows of chain stitches; and inlay yarns knitting-width-wise inlayed rightward and leftward alternately into the stitch row.

In this case as well, as in the case mentioned above, the inlay yarns and/or the stitch rows constituting said at least one of mesh webs are knitting-width-wise shifted by at least one wale, at the required course position in the knitting direction, as to form the marquisette-like structure.

In the three-dimensional marquisette-like knitted fabric according to the present invention, dimensional stability in the knitting and widthwise directions is excellent; shape retainability is preferably maintained, and yarn of the respective mesh webs do not appear on the surface of the other mesh web. Therefore, by using yarns of different materials or colors for these mesh webs; the three-dimensional marquisette-like knitted fabric the front and back sides of which are different in color or texture or which is reversible can be obtained.

In any one of the three-dimensional marquisette-like knitted fabric according to the present invention mentioned above, the front and back mesh webs can be fabricated into the knitting constructions having mesh openings of different arrangements, configurations, or sizes with respect to each other. It is also possible to make; one of the front and back mesh webs into a marquisette-like knitting construction; and the other thereof into a net structure, a mesh structure, or other knitted structure having, honeycomb or rhombus mesh openings.

By making the configuration or the size of the mesh openings on the front and back sides different, the knitted fabrics of net structure having strength, transparency, or light-shielding effect according to the applications can be obtained; and what is more, it has excellent dimensional stability in the knitting and widthwise directions; and thus shape retainability thereof can be preferably maintained.

The present invention encompasses the knitted fabric as formed in a manner that; on at least one of the mesh webs, yarns constituting very one of the mesh webs are draw-tensioned at every first one of required number of courses, so as to make plurality of adjacent wales of the stitch rows get close to each other. In addition, it is also possible to fabricate as follows; at least one of the mesh webs has a marquisette-like construction as formed in a manner that; adjacent ones of the stitch rows are joined by yarns constituting very one of the mesh webs; inlay yarns being inlayed rightward and leftward alternately, at every first one of required number of courses, into said adjacent ones of the stitch rows joined together.

When gathering up or joining the adjacent stitch rows by passing constituent yarn forming the mesh web for a plurality of wales, the number of wales is not necessarily required to be constant, but can be determined as desired; whereby the braids formed by joining a plurality of stitch rows may be made thick or thin as desired; thereby generating a marquisette-like structure having visually effective patterns.

When a plurality of stitch rows are gathered up or joined as mentioned above; the joined stitch rows and pass-between portions of the connecting yarns become as plurality-waled while inclination of the connecting yarns are increased; thus, compressive strength or shape retainability being improved. In addition to it, the mesh openings of a marquisette-like mesh web are enlarged; whereby permeability or light permeability increases while maintaining high compressive strength. Further, since the braids formed by joining a plurality of stitch rows are formed into ridges, unevenness is generated on the surface of the mesh web, thereby preventing slippage.

The braids formed integrally by gathering up or joining stitch rows of a plurality of wales mentioned above have following effects.

(a) The root portion of the pile can be firmly fixed to the braids (main fabric) to stabilize the three-dimensional configuration.

(b) Slippage of inlay yarn or chain stitched yarn, and shrinkage due to washing or the like can be prevented.

(c) Since the root portion of the connecting yarn can be firmly fixed to the integrated braids (main fabric), linearity of cushioning effect and resiliency is improved.

(d) The mesh web of the marquisette-like knitted fabric is given with toughness and resiliency to increase dimensional stability.

According to the present invention, the three-dimensional marquisette-like knitted fabric may be formed in a manner that; at least one of the mesh webs forms a checkered pattern as a whole, as formed in a manner that; inlay yarns are rightward and leftward alternately introduced at each gap between the stitch rows, and at alternately in a pitch of required number of courses. This can enlarge the mesh openings of the mesh web of marquisette-like. This effect increases especially when it is fabricated by gathering up by means of the inlay yarn as mentioned above. When the other one of the mesh webs has a honeycomb shape or other net constructions, the mesh openings of the marquisette-like mesh web corresponding to the mesh openings thereof can be enlarged.

At least one of the front and back mesh webs may be fabricated as follows; supply rate of chain stitch yarns or inlay yarns is varied, or the number of courses corresponding to a mesh opening, or the knitting construction is varied, at every required number of courses. In this arrangement, elasticity and tentering, or the cushioning effect or resiliency may be partially varied; thereby being improved in terms of design and thus it can be preferably used for chair covering or the like.

In still other three-dimensional marquisette-like knitted fabric according to the present invention; the connecting yarns for connecting the mesh webs being passed as slanted at every first one of required number of courses, to be knitting-width-wise shifted by at least one wale when being passed as slanted; and thereby interweb-wise passed portions of the connecting yarns being formed as a marquisette-like structure.

In this case, at least one of the front and back mesh webs may be fabricated in a net structure or a mesh structure including mesh openings of honeycomb or rhombic configuration.

In the three-dimensional marquisette-like knitted fabric according to the present invention, even when the front and back mesh webs has any knitting construction such as a net structure in honeycomb configuration that is easily be deformed; since the portion of the connecting yarn between the front and back mesh webs is formed in a three-dimensional marquisette-like; it has adequately resilient and toughness in construction; thereby having good compressive strength, excellent dimensional stability and shape retainability of the entire knitted fabric in the warp and knitting-width direction, high void content, and preferable air and water conductibility.

In the respective three-dimensional marquisette-like knitted fabrics mentioned above according to the invention, the entire or a part of the connecting yarns for connecting the mesh webs may be knitted in two-needle stitch. Especially, it is fabricated into a marquisette-like structure by knitting two-needle stitch at every required number of courses. In this arrangement, the stability and linearity of the three-dimensional construction is further improved.

In any one of hereto-mentioned three-dimensional marquisette-like knitted fabric of the present invention, the front and back mesh webs can be fabricated by different types of yarns at least one terms of; color, material, physical property,texture, and effect of treatment. In this arrangement, a product having different appearances or textures on the front and back sides can be obtained. In addition, when a heat fusing yarn is employed as at least one type of constituent yarn for the front and back mesh webs and subjected to heat setting, further stability is expected in three-dimensional construction.

In the three-dimensional marquisette-like knitted yarn of the present invention, flexible yarns such as spun yarns or multifilament yarns is employed at least a part of yarns for constituting one or both of the mesh webs. The same flexible yarn as mentioned above can be used for at least a part of the connecting yarn.

Using the flexible yarn for constituent yarn forming the mesh webs realizes a soft texture of the surface of the mesh web. When the entire mesh web is fabricated by the use of flexible yarn, the surface of the mesh web; may be softer. Applying the raising process or shirring process on the surface will exhibit further softer appearance. When the flexible yarn is used for the connecting yarn as well, the flexible cushioning effect can be obtained.

In the three-dimensional marquisette-like knitted fabric of the present invention, yarns having an adequate rigidity such as monofilament yarns are used as a part of the connecting yarns; and flexible yarns such as monofilament yarns, spun yarns, multifilament yarns are also used as a part of the connecting yarns. In this arrangement, the portion having high compressive strength owing to rigid yarns and the portion with flexibility by flexible yarns are mixed; which results in soft resiliency with compressive strength as a whole In addition, the unevenness can be given to the front surface, which may achieve massaging effect or pressure sore preventing effect.

Elastic yarns may be used, at least partly, as yarns for constituting at least one of the mesh webs and/or the connecting yarns. The elastic yarns are preferably; special elastic yarns such as polyester thermo-plastic elastomer yarn having features of rubber and plastic; in addition to elastic yarns such as rubber yarns. Using such elastic yarns can realize enlargement of the mesh openings, elasticity or cushioning effect of the knitted fabric, or resilient fabric without looseness. By using special elastic yarns having a feature that can easily be elongated to a certain extent and exhibits almost no elongation thereafter, it can be used preferably as a covering material for the chair or the like.

In the three-dimensional marquisette-like knitted fabric mentioned above, preferably yarns of high-tensile-strength fibers such as mono-filament fibers, glass fibers, carbon fibers, aramid fibers are used, at least partly, as yarns for constituting at least one of the mesh webs and/or the connecting yarns. By this manner, a marquisette-like knitted fabric having resiliency and toughness, and in addition, having good dimensional stability and shape retainability can be obtained.

In the present invention, at least one of the front and back mesh webs can be fabricated in a manner that; inlay yarns thicker than other web-constituting yarns are rightward and leftward alternately introduced as being shifted by more than one wale at every required course position. By this manner, since the part of the marquisette-like structure formed by thick yarn appears on the surface of at least one of the front and back mesh webs in the shape of a projection, the entire surface of the knitted fabric is uneven; whereby the slippage preventing effect on the knitted fabric increases; and compensation can be achieved without increasing weight per unit area so much.

BEST MODE FOR CARRYING OUT THE INVENTION

Figure 1:
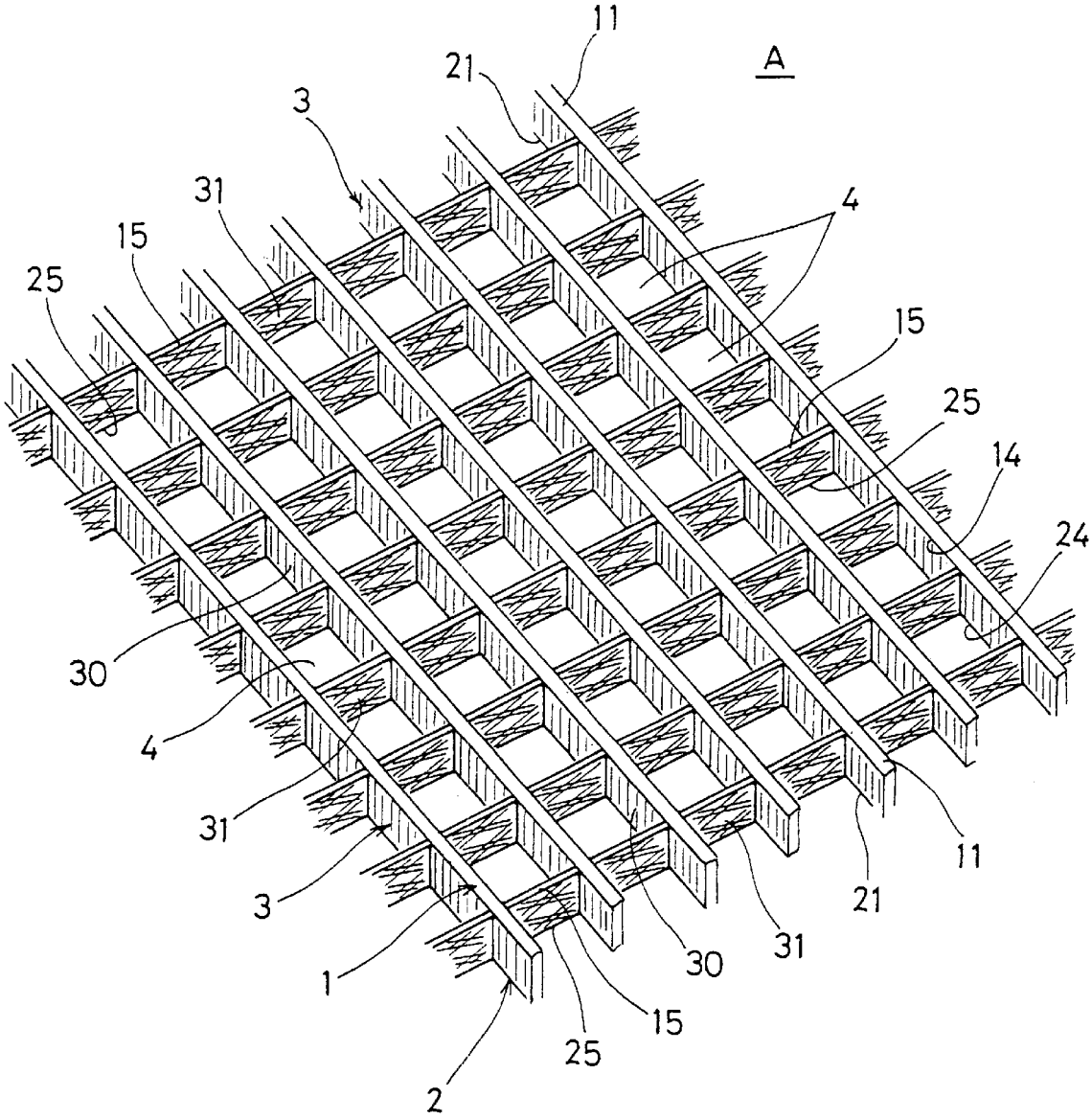
FIG. 1 is a general perspective view showing an embodiment of the three-dimensional marquisette-like knitted fabric according to the present invention.

Referring now to the drawings, the embodiments of the present invention will be described.

FIG. 1 to FIG. 4 show an embodiment of the three-dimensional marquisette-like knitted fabric A according to the present invention. In these figure, the reference numerals 1 and 2 designate the front and back mesh webs in a net construction; the reference numeral 3 designates connecting yarn for connecting together the mesh webs 1, 2 at certain intervals. At least one of the front and back mesh webs 1, 2 (both mesh webs 1, 2 in an illustrated example) is or are fabricated into a marquisette-like fabric in which inlay yarns 5 are inlayed in a width-wise swaying manner into rows of knitting-direction chain stitches at every prescribed number of courses. In this way, in an illustration of the figure, mesh webs are knitted to have quadrangular mesh openings 14, 24, or have a so-called marquisette-like construction.

In the embodiment shown in FIG. 1 to FIG. 4, the front and back mesh webs 1,2 are both fabricated into a marquisette-like construction equivalent with respect to each other; and in the knitting, connecting yarns 3 for connecting both mesh webs 1, 2 are width-wise shifted leftward and rightward alternately, by at least one wale at prescribed intervals in wale, congruently with the marquisette-like construction of mesh webs. Thus, the connecting yarns 3 themselves form a marquisette-like construction. Depending on the application of the three-dimensional net, connecting yarn 3 may be knitted into other construction.

The reference numerals 11 and 21 in the figures designate rows of chain stitches in the knitting direction forming the quadrangular mesh openings 14, 24 of the front and back mesh webs 1 and 2; and the reference numerals 15 and 25 designate pass-between portions of inlay yarns 5 that are passed between the rows of chain stitches 11 and 21 as the inlay yarns 5 are inlayed in a manner of width-wise swaying.

Figure 4:
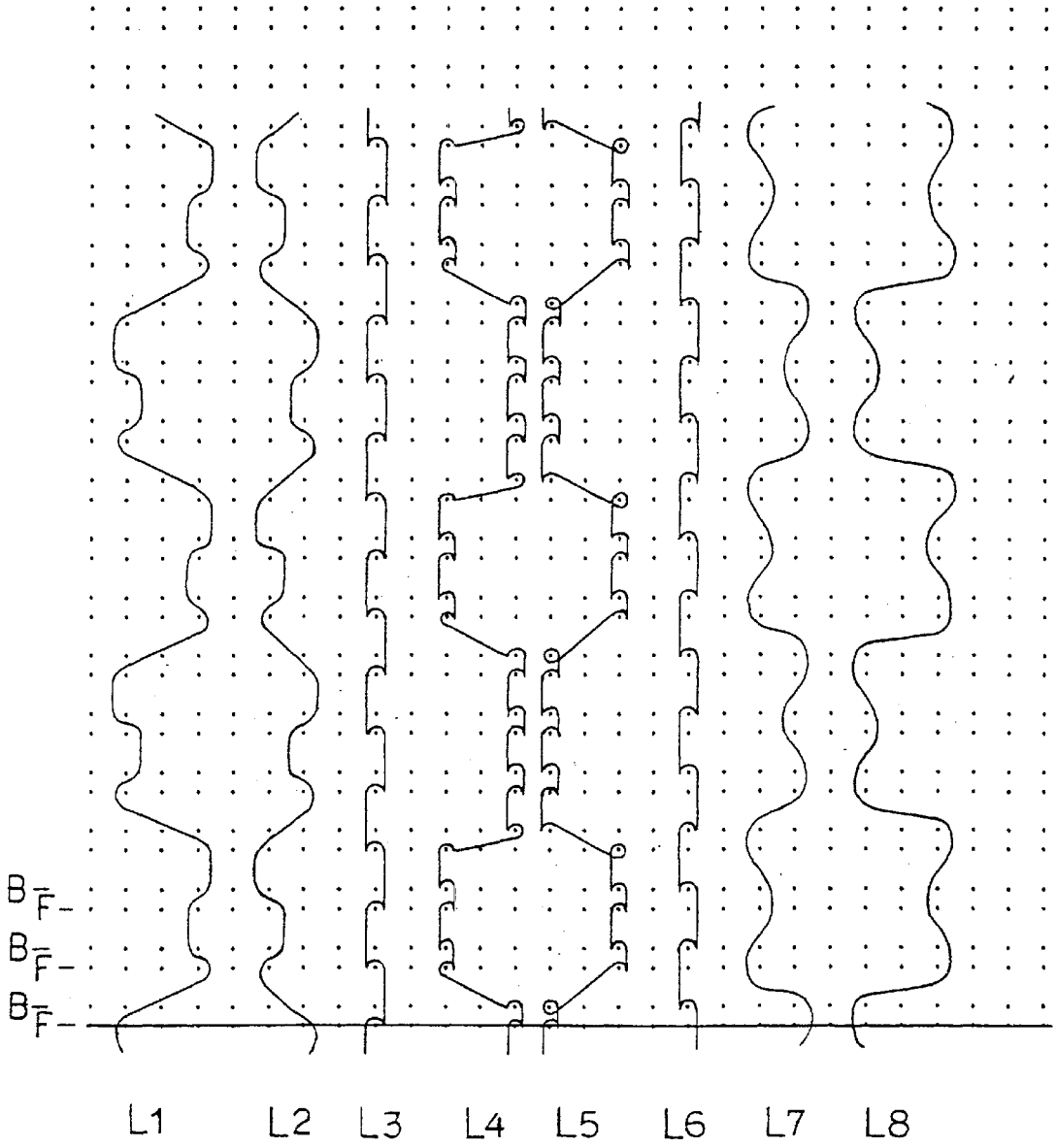
FIG. 4 is a lapping diagram of the respective lines of constituent yarn showing an example of the knitting construction of the three-dimensional marquisette-like knitted fabric shown in FIG. 1.

The three-dimensional marquisette-like knitted fabric A is fabricated for example in a knitting construction shown in FIG. 4 by the double Raschel machine having two rows of needle beds.

In FIG. 4, L3 designates a front-side chain stitch guide bar; L1 and L2 designate front-side inlay yarn guide bars; L4 and L5 designate connecting yarn guide bars; L6 designates the back-side chain stitch guide bar; and L7 and L8 are back-side inlay yarn guide bars.

On the front side of the double Raschel machine, a marquisette-like construction forming the quadrangular mesh openings 14 is knitted as follows by means of the chain stitch guide bar L3, which guides a full set of chain stitch yarns, and the two inlay yarn guide bars L1, L2, each of which guides a full set of the inlay yarns. Into each wale of chain stitches made by the chain stitch guide bar L3, the inlay yarns 5 are zigzag-wise inlayed along a wale for a few courses. The inlay yarns are width-wise guided as swayed rightward and leftward alternately over one or a few wales, at every required number of courses (at every three courses in an illustrated example), which number matches the quadrangular mesh opening 14.

On the back side of the double Raschel machine, as in the front side, a marquisette-like construction forming the quadrangular mesh openings 24 is knitted as follows by means of the chain stitch guide bar L6, which guides a full set of chain stitch yarns, and the two inlay yarn guide bars L7, L8, each of which guides a full set of the inlay yarns. Into each wale of chain stitches made by the chain stitch guide bar L6, the inlay yarns 5 are zigzag-wise inlayed along a wale for a few courses. The inlay yarns are width-wise guided as swayed rightward and leftward alternately over one or a few wales, at every required number of courses (at every three courses in an illustrated example), which number matches the quadrangular mesh opening 24.

According to the knitting construction of FIG. 4, inlay yarns are inlayed in a following manner; each of the inlay yarn guide bars L1 and L8 on the front and back sides knitting-width-wise passes an inlay yarn to the wale two wales away, at every required number of courses mentioned above, and then passes back the inlay yarn to the original wale; meanwhile, each of the inlay yarn guide bars L2 and L7 knitting-width-wise passes an inlay yarn to the wale one wale away, that is, to an adjacent wale, at every required number of courses, and then passes back the inlay yarn to the original wale.

The connecting yarns 3 connect together the mesh webs 1, 2 in a following manner. Two types of connecting yarn guide bars L4 and L5 are used, each of which guides a full set of connecting yarns and, in principle, passes the connecting yarns alternately between the stitch rows 11, 21 of the front and back mesh webs 1, 2 as shown in FIG. 4. The connecting yarn guide bars L4 and L5 are knitting-width-wise shifted by more than one wale, preferably by one or a few wales (by two wales in an illustrated example), leftward and rightward opposite with each other so as to inclined-wise pass the connecting yarns 3 as intersected with each other. The shifting is made at every prescribed number of courses, which number matches the marquisette-like constructions of the front and back mesh webs 1, 2, and thereby matches the quadrangular mesh openings 14, 24 on the front and back sides. Then, the connecting yarn guide bars L4 and L5 are shifted back to the original wale, leftward and rightward opposite with each other, so as to inclined-wise pass the connecting yarns 3 as intersected with each other. The reference numeral 30 in the figures designates pass-between portions, of the connecting yarn, along the stitch row. Meanwhile, the reference numeral 31 designates other pass-between portions, of the connecting yarn, along the pass-between portions of inlay yarns 5.

Figure 2:
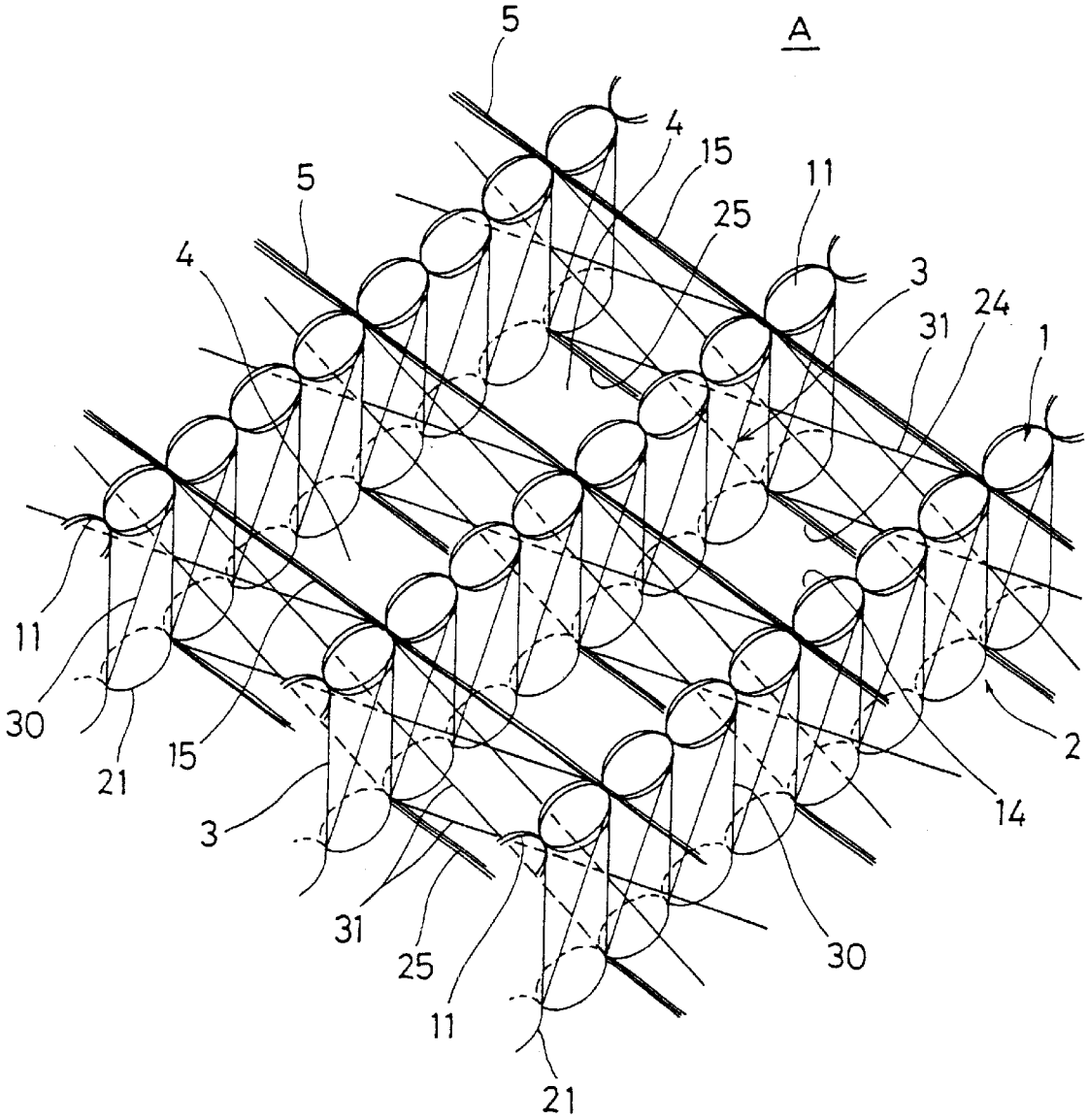
FIG. 2 is an enlarged perspective view showing a part of the three-dimensional marquisette-like knitted fabric shown in FIG. 1.
Figure 3:
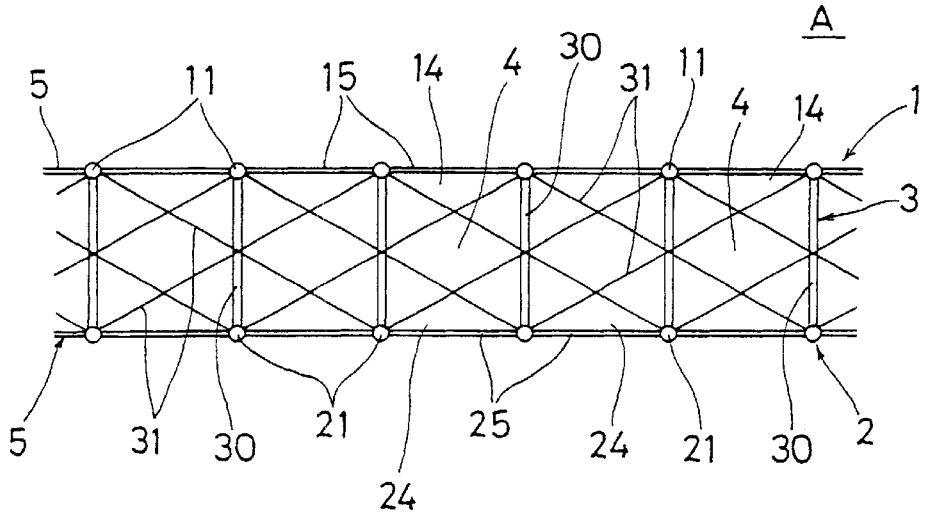
FIG. 3 is an enlarged cross sectional view of the three-dimensional marquisette-like knitted fabric shown in FIG. 1.

In this way, the three-dimensional marquisette-like knitted fabric A is obtained, as shown in FIGS. 1–3, as to be congruent with marquisette-like constructions of the front and back mesh webs 1, 2. In the three-dimensional knitted fabric A, the front and back mesh webs 1, 2 are knitted such that quadrangular mesh openings on the mesh webs 1, 2 are congruent with each other, while connecting yarns 3 are inclined-wise passed as knitting-width-wise shifted at courses corresponding to the intra-web pass-between portions 15, 25 of the inlay yarn 5.

In the three-dimensional marquisette-like knitted fabric A, the stitchrows 11, 21 on the front and back mesh webs intersect, in the knitting and widthwise directions in plan view, with the intra-web pass-between portions 15, 25, of the inlay yarn 5, and with pass-between portions of the connecting yarn 3 along the intra-web pass-between portions 15, 25. Thus, quadrangular three-dimensional mesh spaces 4 are formed directly by knitting without a process of expanding the knitted fabric. In this way, heat setting treatment after knitting is facilitated.

The three-dimensional marquisette-like knitted fabric A has high content of void with slight weight and has excellent air and water conductibility, because the net structure of the knitted fabric A is comprised of the quadrangular three-dimensional mesh spaces 4, and because the net structure defining the three-dimensional mesh spaces is of three-dimensional.

Moreover, the front and back mesh webs 1, 2 is in the marquisette-like construction in such a manner—two inlay yarns 5 are inlayed along each stitch row 11, 21 in the knitting direction; in the knitting-width direction, the intra-web pass-between portions 15, 25 of the inlay yarns 5 are in a state in which a plurality of the inlay yarns 5 are joined together continuously. Therefore, the knitted fabric A has a sufficient tensile strength in the knitting and widthwise directions and has excellent dimensional stability because the quadrangular three-dimensional mesh spaces 4 are hardly changed in shapes even when a tensile strength is applied in the knitting and widthwise directions.

Further, at between the front and back mesh webs 1, 2, the connecting yarns 3 constitute a marquisette-like structure corresponding to the marquisette-like construction of the front and back mesh webs 1, 2. For this reason, each of the quadrangular three-dimensional mesh spaces 4 surrounded by walls of connecting yarns 3 in the knitting and knitting-width directions, where the walls are formed of front-to-backwise pass-between portions of the connecting yarns 3. The each three-dimensional mesh space 4 is surrounded not only by the inclined pass-between portions 30 of the connecting yarns 3 extending in the knitting direction along the stitch row, but also by the slanting pass-between portions 31 extending in the knitting-width direction along the intra-web pass-between portions 15, 25 of inlay yarns 5. The slanting pass-between portions 31 of the connecting yarns 3 exhibit a reinforcing effect with respect to a tensile strength in the knitting-width direction, thereby increasing dimensional stability in the knitting-width direction. Therefore, the knitted fabric as a whole has a good shape retainability and compressive strength. The knitted fabric also has good permeability due to the quadrangular three-dimensional mesh spaces 4; the knitted fabric especially has good air and water conductibility and light transmittance in a direction substantially perpendicular to surfaces of the knitted fabric. Moreover, the knitted fabric has good light-shielding effect and hiding power in inclined directions, which are at an inclined angle with respect to surfaces of the knitted fabric.

Figure 5:
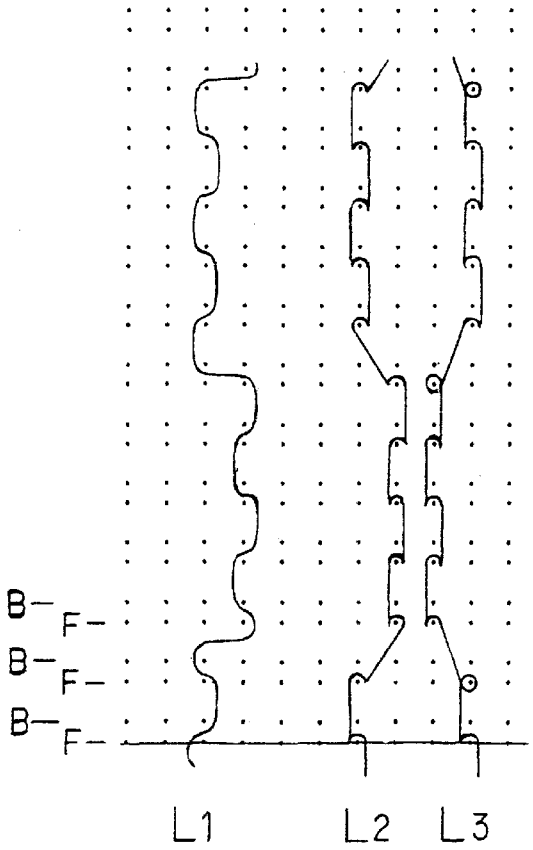
FIG. 5 is a lapping diagram of a part of constituent yarn showing an example of the knitting construction when fabricating a marquisette-like fabric with chain-stitched yarn.

As a way to construct at least one of the mesh webs in a marquisette style, knitting for forming quadrangular mesh openings may be made as shown in FIG. 5: two chain stitch guide bars L2, L3 are used to form two types of chain stitch rows; and the chain stitch rows are knitting-width-wise shifted rightward and leftward alternately to a wale located one wale away, at every prescribed course position in the knitting direction. The shifting may be made in accordance with shifting of the connecting yarn guide bars L4, L5 in the knitting construction shown in FIG. 4 for example. Although the shifting of the inlay yarn does not necessarily have to be coordinated with the shifting of the chain stitch rows, it is preferable for shape retainability that the shifting of the inlay yarn in a rightward and leftward swaying motion is coordinated with the shifting of the chain stitch rows as in the inlay yarn guide bar L1 of FIG. 5.

When to fabricate both of the front and back mesh webs 1, 2 into so called marquisette-like constructions as mentioned earlier, other types of the marquisette-like construction may be adopted as follows, though not shown. Mesh openings on one mesh web may be disposed in staggered position with respect to mesh openings on other mesh web, by making the course positions of the rightward and leftward inlaying of the inlay yarns 5 be different between the front and back mesh webs. In otherwise, sizes of the mesh openings 14, 24 may be made different between the front and back mesh webs. Such construction may be obtained by making knitting gauge be different between the front and back mesh webs, or by making interval of the rightward and leftward inlaying, or number of courses between the inlaying, be different between the front and back mesh webs.

In such knitting constructions as well, it is preferred that the connecting yarns 3 forms a marquisette-like constructions matching those of the front and back mesh webs 1, 2 as in the knitting construction mentioned earlier. However, the connecting yarns 3 may form constructions other than the marquisette-like construction, depending on uses of the three-dimensional knitted fabric.

In otherwise, the knitted fabric may be fabricated in a following manner. In a knitting construction of FIG. 4, inlay yarns of at least one of the inlay yarn guide bars L2 and L7 are rightward or leftward passed at every courses to a wale or wales at least one wale away, as to form plane webs; and inlay yarns of the inlay yarn guide bars L1 and L8 constitute a marquisette structure. When inlay yarns used for the inlay yarn guide bars L1 and L8 is thicker than inlay yarns for the inlay yarn guide bars L2 and L7, surfaces of mesh webs become uneven as the marquisette structure of the thicker inlay yarn appears as protruding portions on the mesh web. Thus, slippage preventing effect is achievable.

In otherwise, one of the front and back mesh webs 1, 2 may have an unpatterned construction such as plain stitch for example, while the other mesh web among the mesh webs 1, 2 has the marquisette-like construction, though not shown in the figures.

One of the front and back mesh webs 1, 2 may have a honeycomb construction or net constructions other than the marquisette type while constructing the other mesh web among the mesh webs 1, 2 as of the marquisette type, whereas in the above-mentioned embodiment, all the front and back mesh webs 1, 2 as well as pass-between portions of the connecting yarns 3 constitute marquisette-like constructions.

Figure 6:
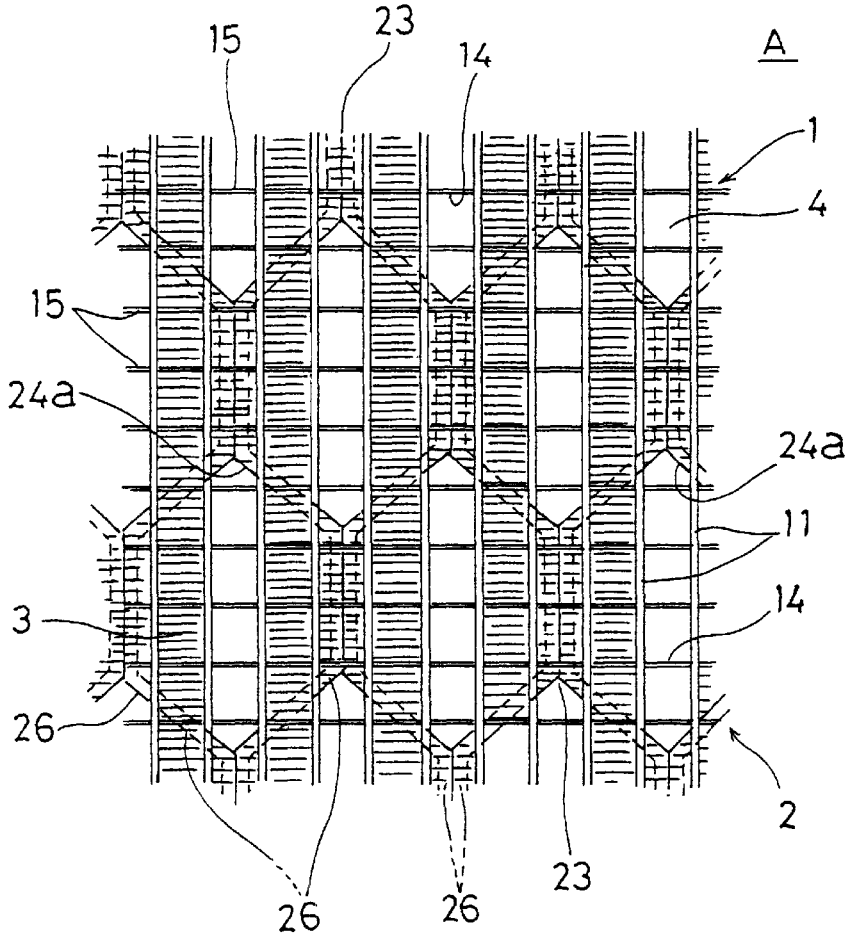
FIG. 6 is a general plan view of the three-dimensional marquisette-like knitted fabric according to another embodiment of the present invention.
Figure 7:
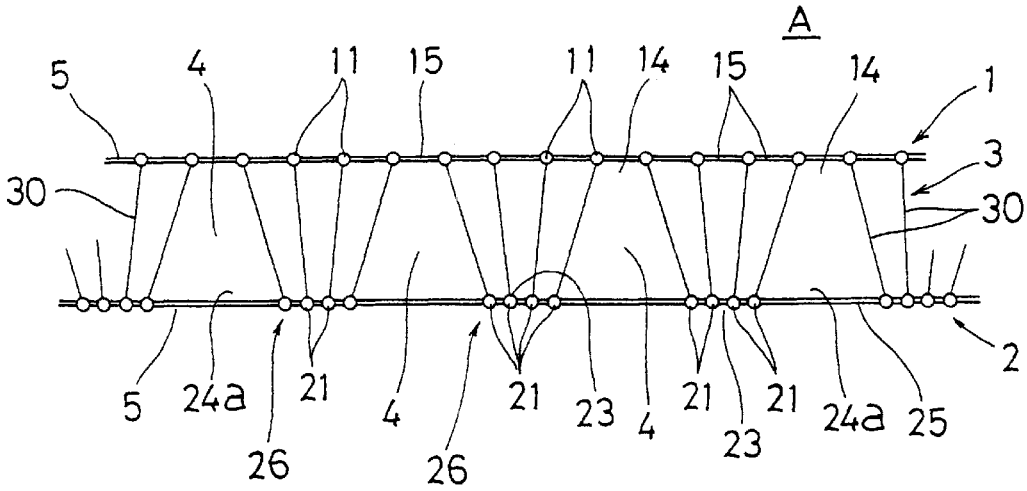
FIG. 7 is a general cross sectional view of the three-dimensional marquisette-like knitted fabric shown in FIG. 6.

For example, invention-wise three-dimensional knitted fabric may be embodied as shown in FIG. 6 and FIG. 7. The front mesh web 1 is fabricated into a marquisette-like construction as mentioned above. The back mesh web 2 is fabricated as follows; a stitch row 21 of one or more wales is formed by a chain stitch continuous in the knitting direction and an inlay yarn zigzag-wise inlayed into such chain stitch; one of the stitch rows 21 is joined alternately with rightward and leftward adjacent one of the stitch rows 21, at every predetermined number of courses; in this way, polygon-shaped mesh openings 24*a* are formed such as in substantially hexagon or honeycomb shape or in substantially quadrangles or rhombic shape.

Figure 8:
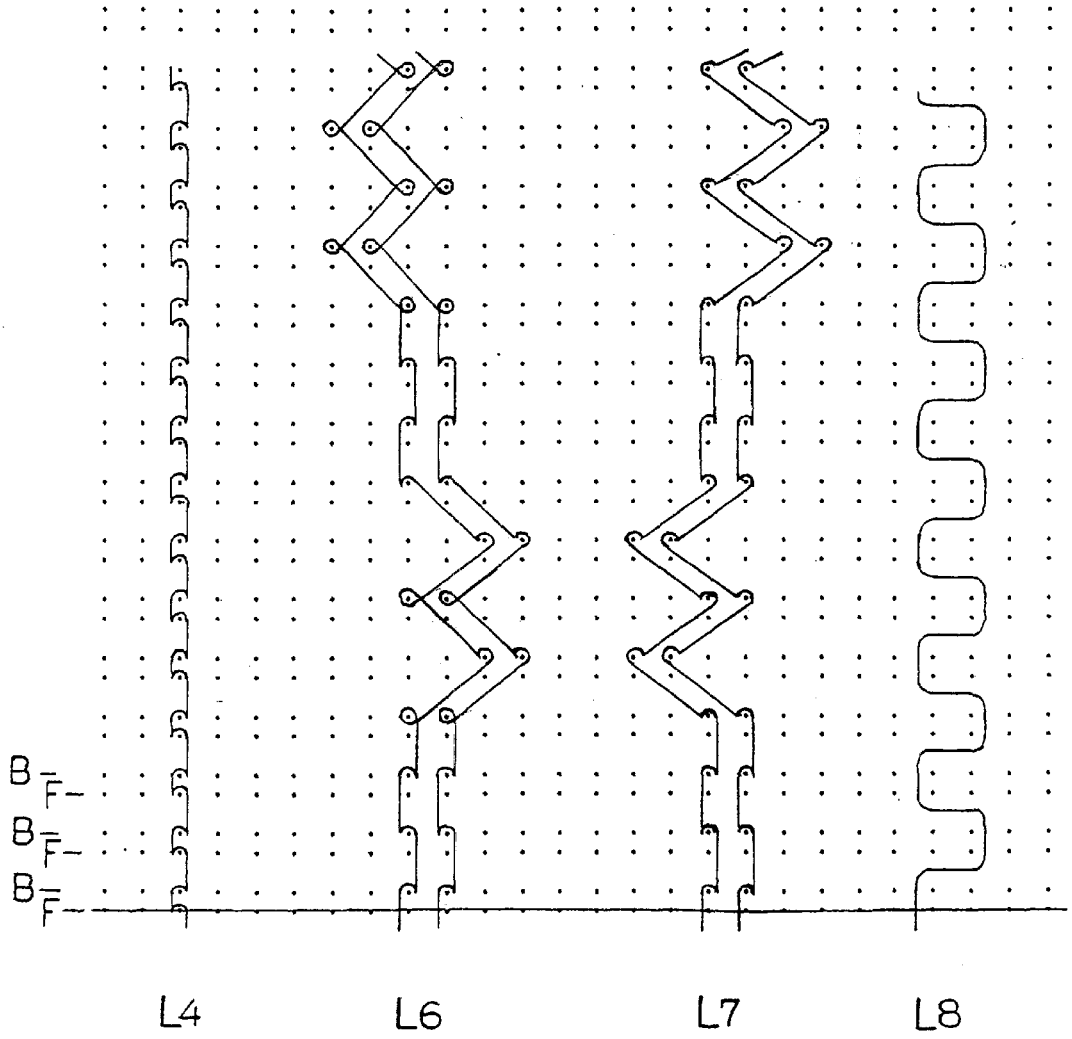
FIG. 8 is a lapping diagram showing a part of constituent yarn showing an example of another knitting construction of the three-dimensional marquisette-like knitted fabric shown in FIG. 6.

FIG. 8 shows an example of knitting construction with respect to the back mesh web 2 and the connecting yarn 3, in the marquisette-like knitted fabric A of this embodiment. Knitting motion of the front-side chain stitch guide bar L3, which is for fabricating the front mesh web 1 of the marquisette-like construction, and knitting motion of the inlay yarn guide bars L1, L2 are in the same manner as in the construction in FIG. 4. According to the FIG. 8, the back web mesh 2 is fabricated as follows. Two types of chain stitch guide bars L6, L7 are used to alternately guide chain stitch yarns in a manner each two of the chain stitch yarns are guided together in a set. An inlay yarn guide bar L8 is used for guiding the inlay yarns at every two wales. Into chain stitches made by the chain stitch guide bars L6, L7, the inlay yarns 5 are zigzag-wise inlayed. Thus, each of braids 26 for defining polygon mesh openings 24*a* is fabricated by the stitch rows 21 of two wales. The chain stitch guide bars L6, L7 are rightward and leftward alternately shifted by two wales at every predetermined number of courses, so as to join with rightward and leftward adjacent stitch rows that constitute braids respectively. The reference numeral 123 designates the junction. In this way, the mesh web 2 is constructed in a net construction having polygon mesh openings 24*a* such as a honeycomb shape.

The connecting yarn 3 is passed between the stitch row 11 of the marquisette-like construction and the stitch row 21 of the net construction alternately by one type of the connecting yarn guide bar L4 for guiding a full set of yarns to connect them with each other.

In this arrangement, the shape or size of the mesh openings 14, 24*a* are different on the front mesh web 1 and on the back mesh webs 2 even when they are fabricated with the same gauge. Therefore, it is easily possible to make the mesh openings 14 of one mesh web 1 in the marquisette-like construction smaller, and the mesh openings 24*a* of other mesh web 2 in a net construction larger. Of course, it is also possible to fabricate the front and back mesh webs with different gauges. Each of the connecting yarns 3 for connecting the front and back mesh webs 1, 2 is passed between the stitch rows 11, 21 of front-to-back-wise matching wales. Such front-to-back-wise pass-between portions 30 are slanted rightward and leftward with respect to inter-braids (26) junction 23 on the mesh web 2 of a net construction.

The three-dimensional marquisette-like knitted fabric A has advantages as follows. The marquisette-like construction on one of the front and back mesh web 1 provides sufficient tensile strength in both knitting and knitting-width directions and excellent dimensional stability in the knitting and knitting-width directions. In addition, the net construction of the other mesh web 2 and inclination of the connecting yarn 3 provide improved compression resistance and shape retainability of the three-dimensional construction when a load is applied in thickness-wise direction, which is perpendicular to the surface of the mesh web; thereby improved cushioning effect is achieved; as well as improved conductibility for air and water and improved light transmittance. Because of these advantages, the invention-wise knitted fabric A may be preferably used in variety of applications.

Figure 9:
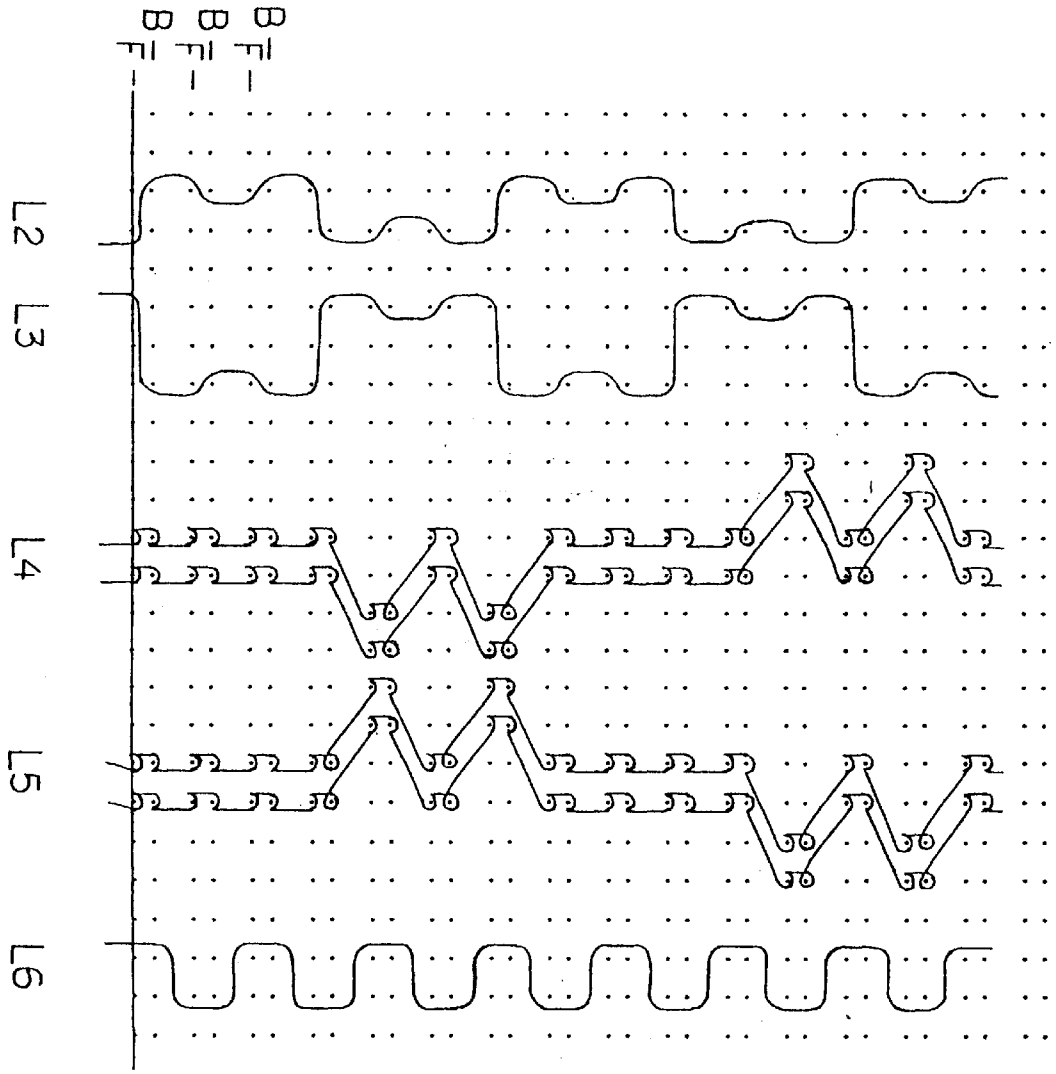
FIG. 9 is a lapping diagram showing the knitting construction of connecting yarn when constructing a row of chain stitches with connecting yarn.

In the three-dimensional marquisette-like knitted fabric A mentioned above, the rows of chain stitches on the front and back sides may be constructed with the connecting yarns by adopting knitting as in FIG. 9 if both of following (1) and (2) are in a case: (1) when one of the front and back mesh webs 1 is constructed in a marquisette type, and the other one of the mesh web 2 is constructed in a net construction such as a honeycomb shape; (2) if there is only a small distance between the bobbins of the needle bed on the front and back sides, that is, between the front mesh web and the back mesh web. By adopting such construction, the chain stitch yarns are omittable, as omittable are the chain stitch guide bars L3 and L6 in the construction diagram shown in FIG. 4 and the chain stitch guide bars L6, L7 in FIG. 8; thus, reduction of weight is feasible, as to improve economic efficiency. In addition, it enables to fabricate thinner knitted fabrics. It is also applicable where both mesh webs are formed in a marquisette-like construction. In addition, by applying heat setting thereto, the tightness at the junctions is improved, thereby increasing stability.

Figure 10:
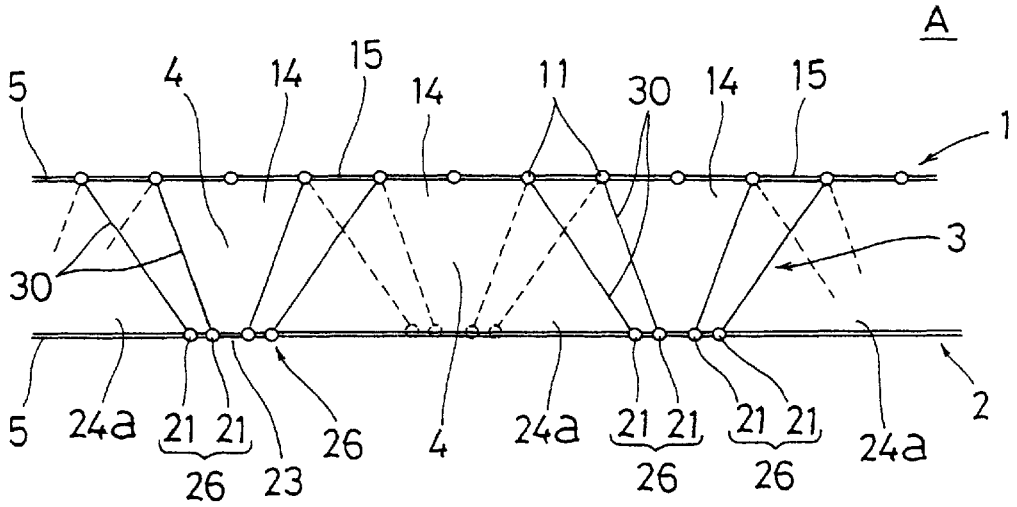
FIG. 10 is a general cross sectional view showing a part of the three-dimensional marquisette-like knitted fabric according to another embodiment of the present invention.

If the front mesh web 1 (or back mesh web 2) has a marquisette-like construction and the back mesh web 2 (or front mesh web 1) has a net construction such as honeycomb shaped in the above-mentioned embodiment, following knitting may be adopted, when to increase the inclination angle of the pass-between portions 30 of the connecting yarns 3. As shown in FIG. 10, on the back mesh web 2, guiding and introducing of the chain stitch yarn is skipped for a predetermined wales of chain stitch row that matches number of wales (for example, one wale) in a braid 26 defining the mesh openings 24*a* on the back mesh web 2. Thus increased is interval of the braids 26, which defines the mesh openings 24*a*. In such manner of knitting, with respect to front mesh web 1, front-to-back-wise passing of connecting yarns 3 may be skipped for wales of stitch row 11 that matches the wales, on the back mesh web 2, skipped with introducing of the stitch yarns.

Figure 11:
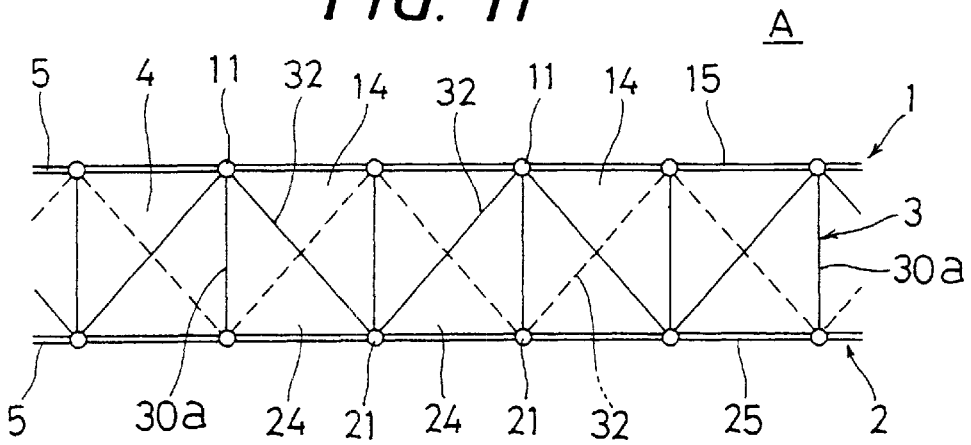
FIG. 11 is a general cross sectional view showing a part of the three-dimensional marquisette-like knitted fabric according to another embodiment.
Figure 12:
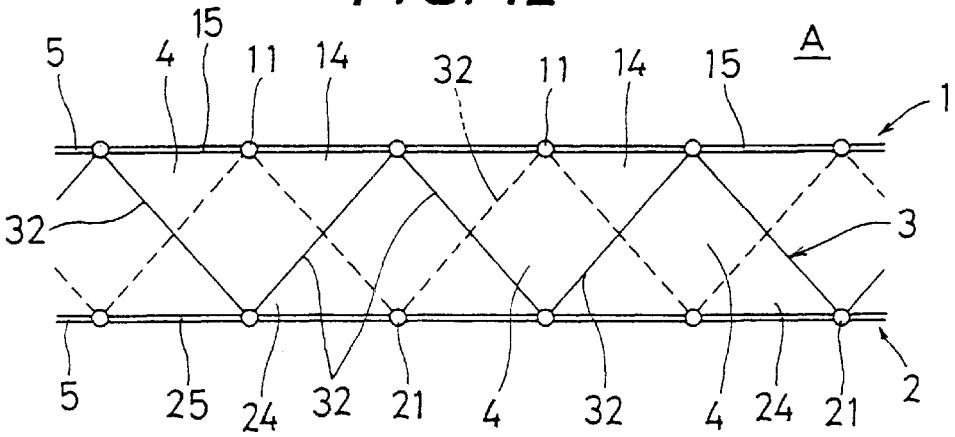
FIG. 12 is a general cross sectional view showing a part the three-dimensional marquisette-like knitted fabric of still another embodiment.

If the three-dimensional marquisette-like knitted fabric A has marquisette-like constructions on both of the front and back mesh webs 1, 2, for example, front-to-back-wise passing of the connecting yarns 3 along the knitting direction, which is along the stitch rows, is made to be rightward or leftward inclined in following manner; and at predetermined course position, the front-to-back-wise passing is made between a first wale on one mesh web and second wales, on another mesh web, shifted by at least one wale rightward or leftward from the wale that matches the first wale on the one mesh web. In this way, as shown in FIGS. 11 and 12, truss structure is formed to have slanting yarn portions rightward and leftward slanted with respect to the mesh webs 1, 2. In otherwise or in addition to the above construction, yarn-crossing structure as in FIGS. 13 and 15 may be adopted where yarns slanted as staggered are intersected with each other to form X shape.

Figure 13:
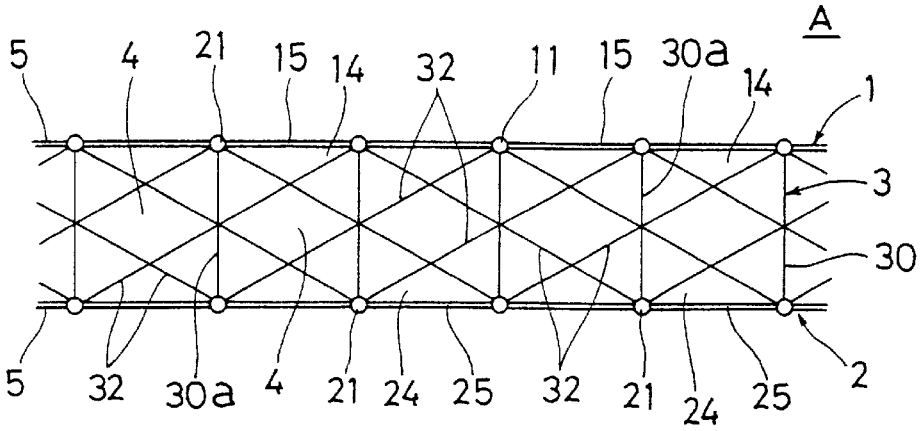
FIG. 13 is a general cross sectional view showing a part of the three-dimensional marquisette-like knitted fabric of still another embodiment.
Figure 15:
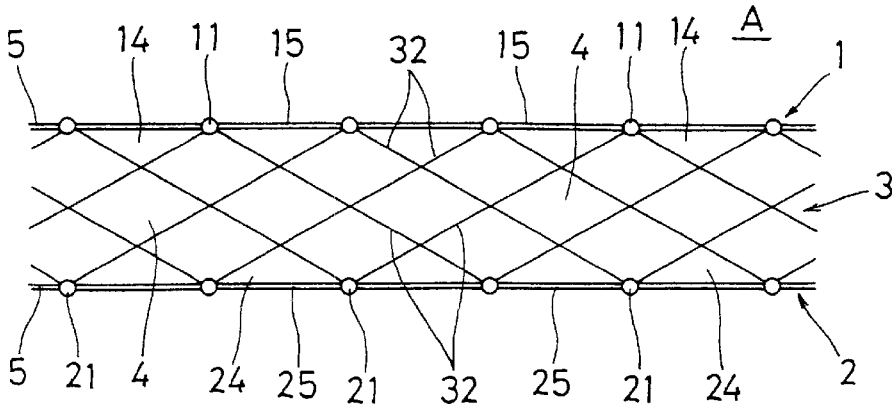
FIG. 15 is a general cross sectional view showing a part of the three-dimensional marquisette-like knitted fabric of still another embodiment.

In each of the above examples, front-to-back-wise slanted passing of the connecting yarns 3 may be made at every course for passing of the connecting yarns 3, for example, as in FIGS. 13 and 15; adopting of such manner is not limited to examples having front-to-back-wise pass-between portions respectively perpendicular and slanted to the mesh webs 1, 2. In this way, front-to-back-wise pass-between portions perpendicular to the mesh webs 1, 2 are eliminated; in other word, the connecting yarns 3 do not pass between front-to-back-wise opposing stitch rows 11, 12. In otherwise, as shown in FIG. 11 and FIG. 13, two types of front-to-back-wise pass-between portions may be mixed alternately; pass-between portions 30*a* perpendicular to the front and back mesh webs are mixed one-by-one alternately with pass-between portions 32 inclined to the mesh webs, as front-to-back-wise passing of the connecting yarns are made in such manner one of the connecting yarns is passed as inclined at interval of a few or several courses. Manner of combination in respect of such two types of pass-between portions may be varied properly; and position of inclined-wise passing may be set freely. For example, it is possible to distribute the inclined portion 32 only to the positions shown in a solid line in FIG. 11 and FIG. 12, or to distribute the same alternately to the positions shown in a solid line and in a dotted line.

Figure 17:
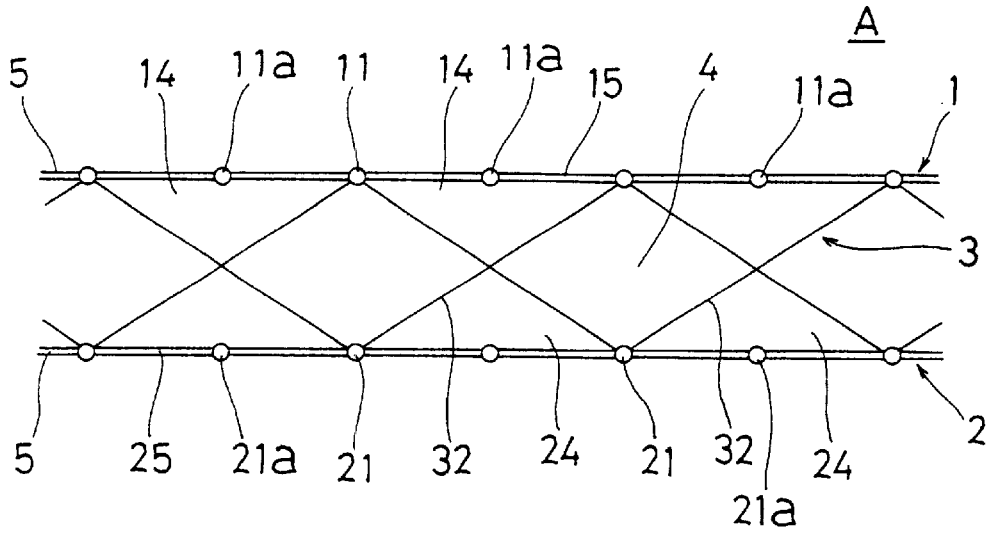
FIG. 17 is a general cross sectional view showing a part of the three-dimensional marquisette-like knitted fabric according to another embodiment of the present invention.

Further, as shown in FIG. 17, stitch rows 11*a*, 21*a* not connected with connecting yarns 3 may be arranged as mixed with stitch rows 11, 21 connected with connecting yarns 3. Such arrangement is obtainable when, on at least one of the mesh webs in the above-mentioned three-dimensional marquisette-like knitted fabric A, introducing of and connecting with the connecting yarns 3 is skipped for some wales of the stitch rows at arbitrary course positions, for example, at interval of one or more wales.

Such three-dimensional marquisette-like knitted fabrics A may be obtained when the guiding pattern of two types of connecting yarn guide bars L4, L5 as well as lapping state such as shown in FIG. 4 are modified properly.

Figure 14:
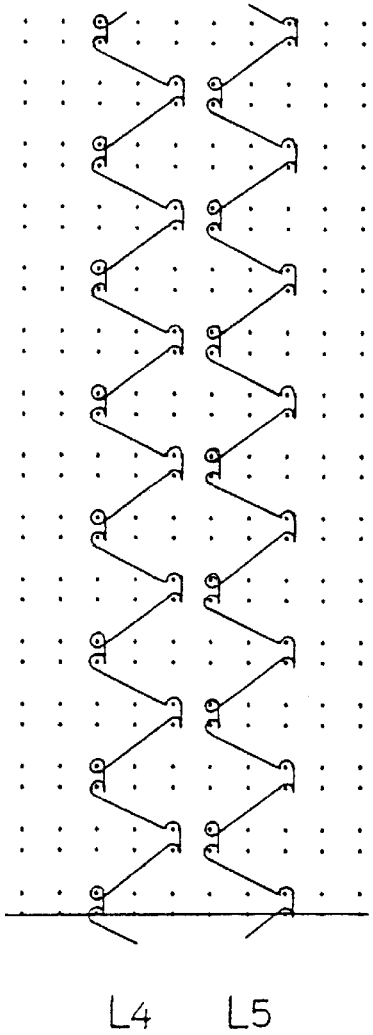
FIG. 14 is a lapping diagram of connecting yarn for the three-dimensional marquisette-like knitted fabric shown in FIG. 13.

For example, the three-dimensional marquisette-like knitted fabric A of FIG. 13 may be obtained as follows, as in knitting construction of FIG. 14: two types of connecting yarn guide bars L4, L5 are used which are in the knitting construction shown in FIG. 4; the connecting yarns 3 are passed between the front and back mesh webs from one to the other or vise versa at every course; and simultaneously, each two of the connecting yarns 3 are shifted rightward and leftward alternately in the opposite direction to at least one wale (two wales as illustrated in the figure) away from respective wales opposed to each other; in this way, the two connecting yarns are intersected with each other in an X shape. In such knitting, filtering effect may be improved when each of connecting yarn guide bars L4, L5 guides a full set of the connecting yarns. The number of wales to be shifted when being passed may be varied such as one wale, two wales, or three wales.

Figure 16:
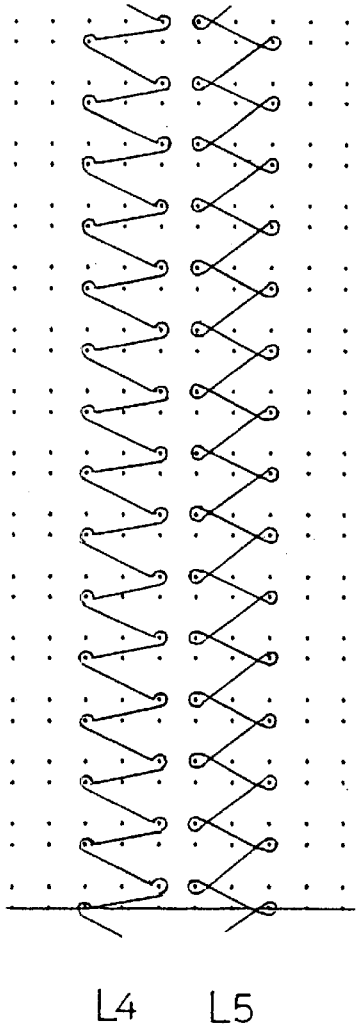
FIG. 16 is a lapping diagram of connecting yarn for the three-dimensional marquisette-like knitted fabric shown in FIG. 15.

The three-dimensional marquisette-like knitted fabric A of FIG. 15 may be obtained as in knitting construction of FIG. 16, by use of two types of connecting yarn guide bars L4, L5 are used which are in the knitting construction shown in FIG. 4. By the knitting construction of FIG. 16, connecting yarn 3 is omitted at between front-to-back-wise opposing wales of the stitch row 11, 21. The knitted fabrics of FIG. 13 and FIG. 15 are suitable to a filter a matter of course, but are also suitable, due to plain fabric property thereof, to wide uses such as cloths, night wears, bed items, bed clothing, chair covers where the plain fabric property is effectively utilized.

These types of the three-dimensional marquisette-like knitted fabric A have advantages as follows. Inclined-wise pass-between portions of the connecting yarns 3 are present as being passed within the quadrangular three-dimensional mesh spaces 4 in view from at least one of the web meshes 1, 2 in a marquisette-like construction, of the knitted fabric A. Thus, knitting-direction-wise continuous portions that define the three-dimensional mesh spaces 4 are prevented to be collapsed. Therefore, the knitted fabric A has a good shape retainability, an improved compressive strength, an improved thickwise dimensional stability, as well as a good filtering property when used as a filter.

Thickness as well as thickness-wise cushioning property may be partly varied by properly varying the arrangement of; the pass-between portions 30*a* perpendicular to the mesh webs; as well as the pass-between portions 32 inclined to the mesh webs.

Hereto mentioned arrangements of the pass-between portions of the connecting yarns 3 are also applicable in same way to; a case where one of the front and back mesh webs 1 and 2 has a marquisette-like construction; and to a case where mesh openings on one of the mesh webs differ with those on another.

Figure 18:
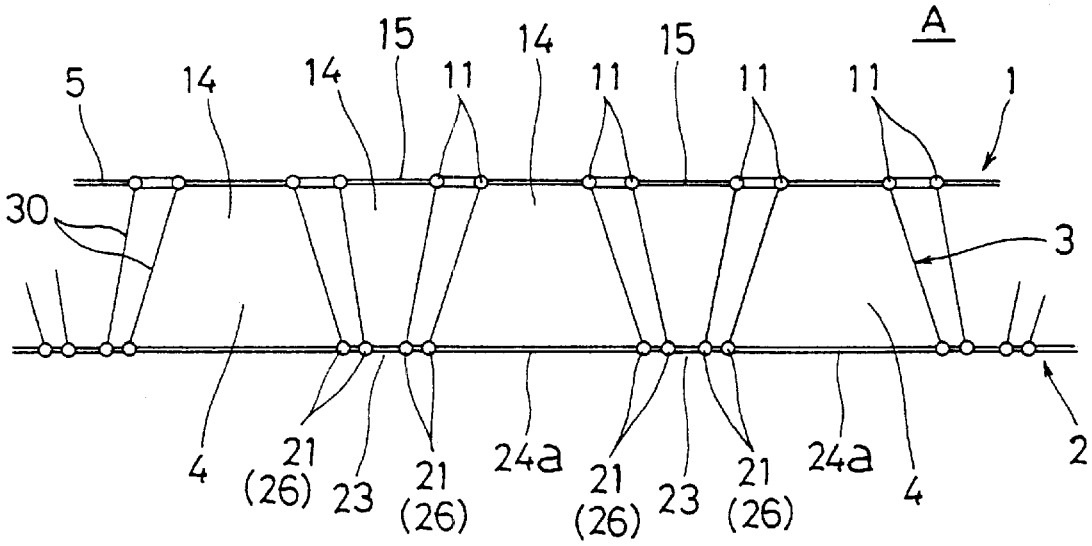
FIG. 18 is a general cross sectional view showing a part of the three-dimensional marquisette-like knitted fabric according to still another embodiment of the present invention.
Figure 19:
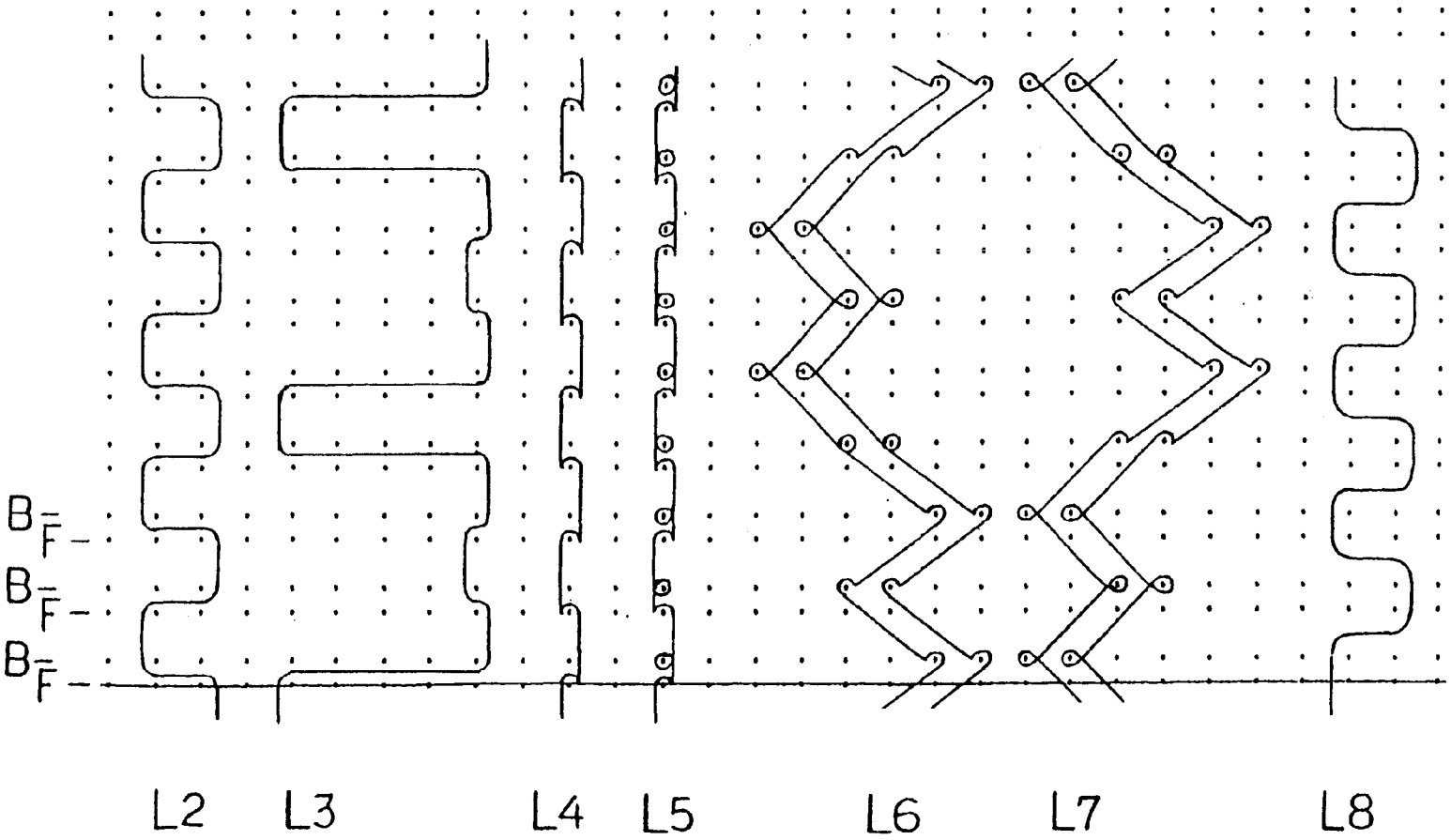
FIG. 19 is a lapping diagram of each constituent yarn showing an example of the knitting construction shown in FIG. 18.

FIG. 18 and FIG. 19 show an example where the adjacent stitch rows 11 of a plurality of wales are gathered up by the inlay yarn 5 so as to get closer at every first one of the required number of courses (sometimes, all the courses); assuming that the front mesh web 1 (or back mesh web 2) has a marquisette-like construction and the back mesh web 2 (or front mesh web 1) has a net construction such as. honeycomb shaped. Knitting is made as in the knitting construction shown in FIG. 19 as follows; the marquisette-like construction, on the front mesh web is fabricated by the chain stitch guide bar L4 and the inlay yarn guide bar L3; the inlay yarns for gathering are guided and inlayed into the marquisette-like construction by the inlay yarn guide bar L2 for gathering; in such inlaying, one of the inlay yarns is inlayed into every two wales; the gathering is made by controlling yarn supply rate of the inlay yarns for gathering, so that adjacent stitch rows 11, 11 come closer to each other.

By such manner of knitting, the quadrangular mesh openings 14 on the marquisette-like construction is able to be partially enlarged; for example, among the mesh openings 14 on the front mesh web 1, the mesh openings 14 matching with the mesh opening 24*a* of the mesh web 2 in a net construction may be enlarged, as to widen the three-dimensional mesh spaces 4. In addition, knitting-width-wise slipping of the inlay yarns is prevented as to enhance the stability of the three-dimensional configuration of the connecting yarns; and thus the connecting yarns are firmly fixed to the mesh web; thereby enhancing its linearity of physical property. Further, slippage-preventing property is improved by the effect of the ridges of the marquisette-like construction.

Figure 20:
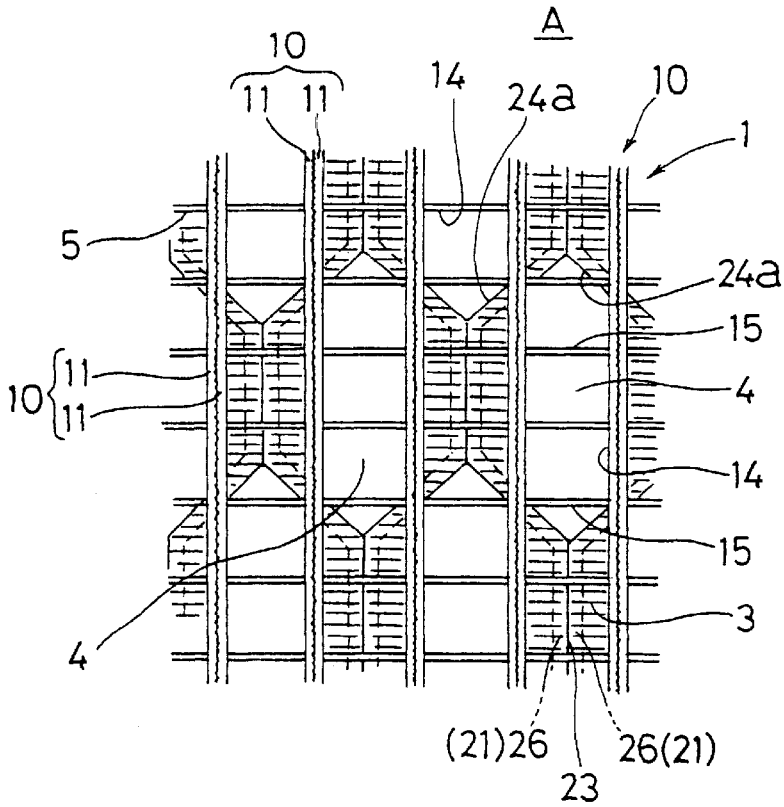
FIG. 20 is a general plan view showing a part of the three-dimensional marquisette-like knitted fabric according to still another embodiment of the present invention.
Figure 21:
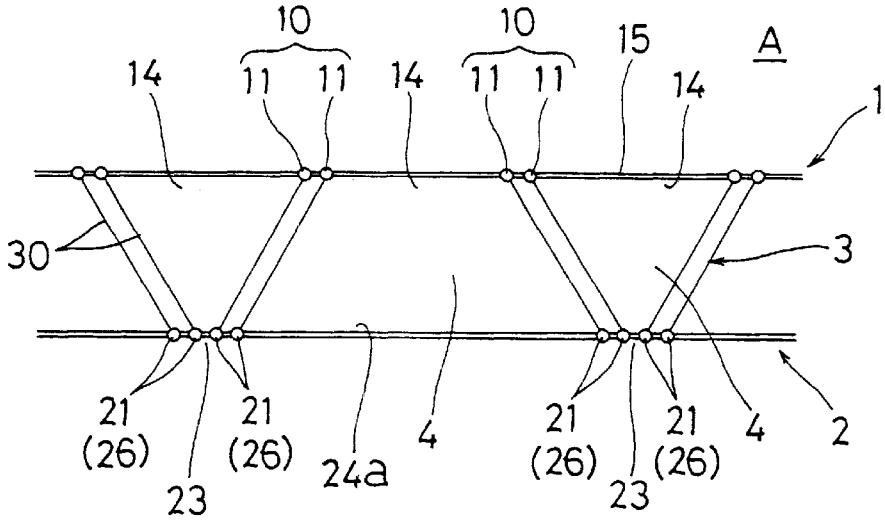
FIG. 21 is a general cross sectional view showing a part of the three-dimensional marquisette-like knitted fabric in FIG. 20.

FIG. 20 and FIG. 21 show an example where the front mesh web 1 is formed in a marquisette-like in such a manner; adjacent stitch rows 11, 11 are connected by yarns constituting the front mesh web 1; the connection is made at every first one of a plurality of wales; and the inlay yarn 5 is knitting-width-wise inlayed rightward and leftward, by a predetermined number of courses, to the connected stitch rows 10; assuming that the front mesh web 1 (or back mesh web 2) has a marquisette-like construction and the backmesh web 2 (or front mesh web 1) has a net construction such as honeycomb shaped.

By such manner of knitting as. in the previous example, the quadrangular mesh openings 14 of the marquisette-like construction is able to be partially enlarged; for example, among the mesh openings 14 on the front mesh web 1, the mesh openings 14 matching with the mesh opening 24*a* of the mesh web 2 in a net construction may be enlarged, as to widen the three-dimensional mesh spaces 4. In addition, the stability of the three-dimensional configuration of the connecting yarns is improved; and thus fixing of the connecting yarns onto the mesh web is improved; thereby linearity is enhanced. Further, slippage-preventing property is improved by the effect of the ridges of the marquisette-like construction.

In both cases of gathering up or connecting the adjacent stitch rows by constituent yarn of the mesh web at every first one of a plurality of wales, the number of the stitch rows may be arbitrary set as desired; thus, visual patterns may be made to appear.

Figure 22:
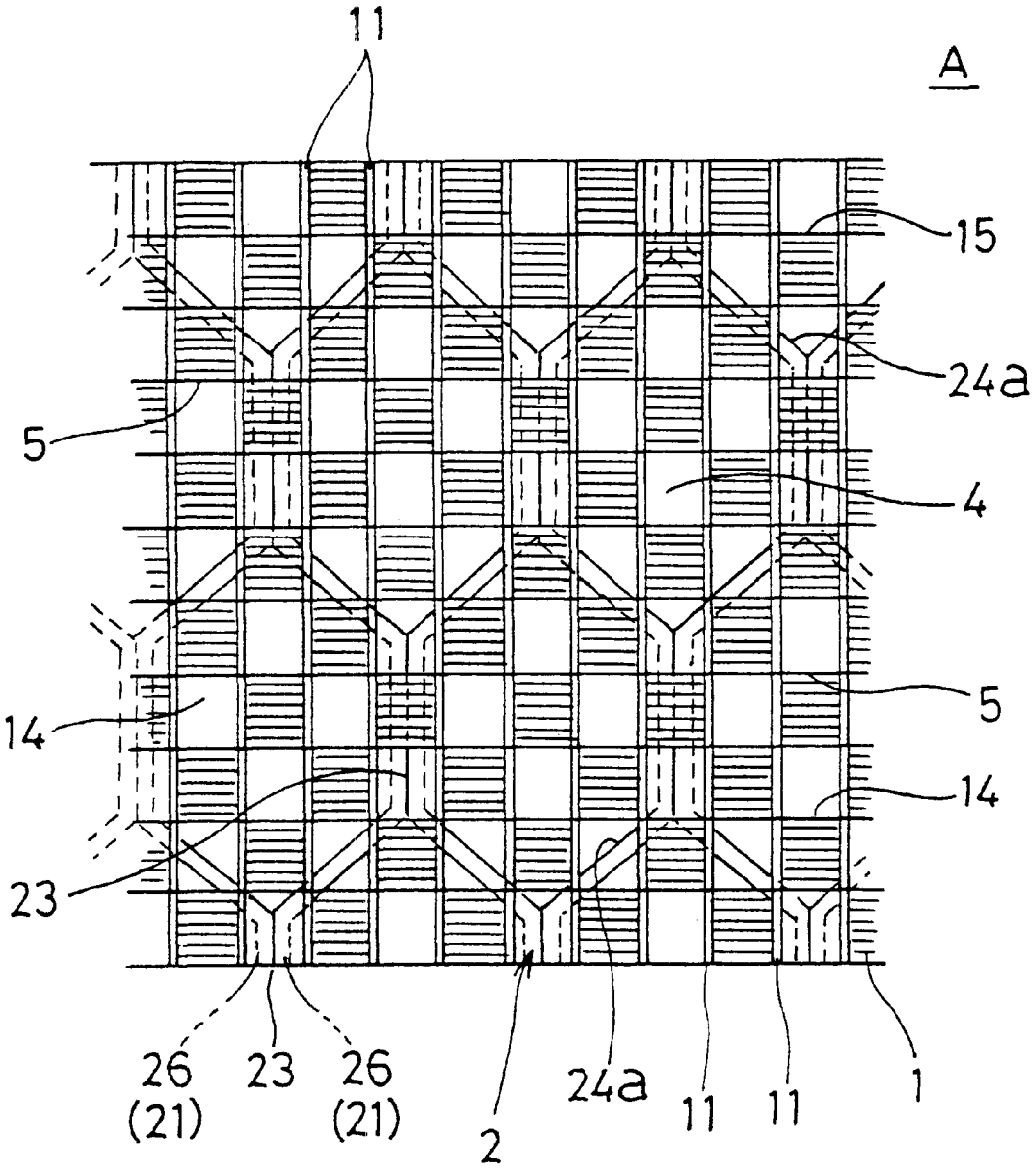
FIG. 22 is a general plan view showing a part of the three-dimensional marquisette-like knitted fabric according to still another embodiment of the present invention.

FIG. 22 shows an example where the front mesh web 1 (or back mesh web 2) in a marquisette-like construction has a checkered pattern in such manner—inlay yarns 5 are inlayed as shifted rightward and leftward alternately by predetermined number of courses, to every first one of two stitch rows 11. By such manner of knitting, the quadrangular mesh openings 14 on the marquisette-like construction may be enlarged, as to widen the three-dimensional mesh spaces 4;

in this way, the conductibility is particularly enhanced. Especially, if the inlay yarns 5 are draw-tensioned while knitting as to gather up the fabric, the above effects further increase. Meanwhile, the connecting yarns are not shown in FIG. 22.

These manner of knitting—gathering up or connection of the adjacent stitch rows, as well as inlaying of inlay yarns for forming checkered patterns on the mesh web in a marquisette-like construction—may be applied to the knitted fabrics where both of the front and back mesh webs 1, 2 are in marquisette-like construction.

Gathering up or connection of the adjacent stitch rows by the constituent yarn has an effect to prevent the connecting yarn from making protrusions on the surface of the mesh web.

The present invention may be embodied as follows, not limited to hereto mentioned examples; neither of the front and back mesh webs has a marquisette-like construction while the knitting fabric is comprised of the front and back mesh webs and the connecting yarn; guiding position of the connecting yarns are shifted as in connecting yarn guide bar L4 in the FIG. 4 for example; the shifting is made knitting-width-wise by more than one wales so as to make the connecting yarns being passed as inclined at every first one of predetermined courses; thus, the pass-between portions of the connecting yarns form a marquisette-like construction.

Although both of the front and back mesh webs in this case may be of plain knitting, it is preferable in view of void content, air and water conductibility, and weight reduction, that at least one of the mesh webs has a reticulated construction such as a net construction or a mesh construction having mesh openings in a honeycomb shape or a rhombic shape. By such manner as well, the knitted fabric has good dimensional stability and shape retainability in the knitting and widthwise directions irrespective of the knitting construction of the front and back mesh webs.

Figure 23:
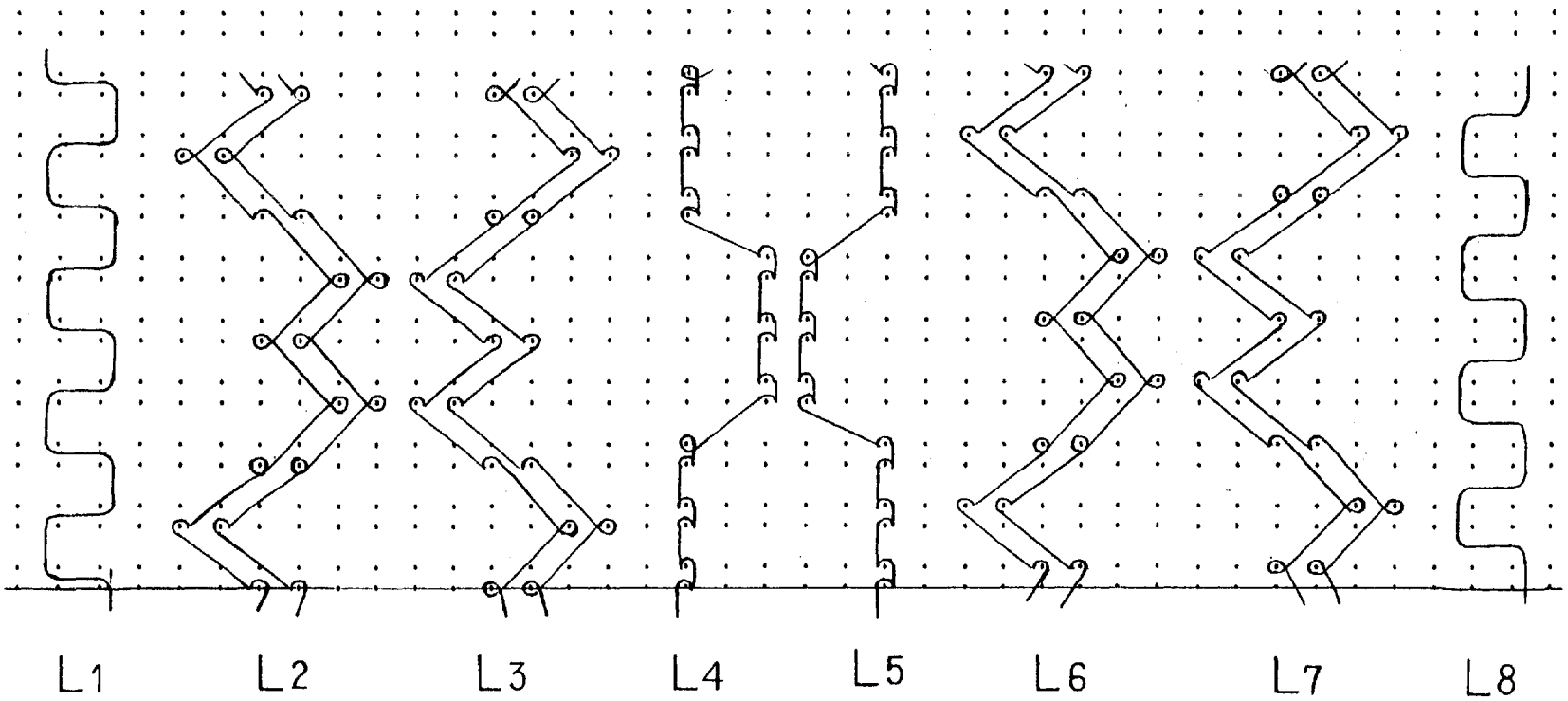
FIG. 23 is a lapping diagram of constituent yarn showing an example of the knitting construction of the three-dimensional marquisette-like knitted fabric according to still another embodiment of the present invention.

FIG. 23 shows an example of the knitting construction according to the embodiment, in which both of the front and back mesh webs are in a net construction. Front and back mesh webs having "net" constructions are knitted as follows; on front side and back side of the knitting, respectively used are the chain stitch guide bars L2, L3 and L6, L7, as well as the inlay yarn guide bars L1 and L8; the chain stitch guide bars L2 and L3 or L6 and L7 alternately guide respective sets of two chain stitch yarns, while each of the inlay yarn guide bars L1 and L8 guides an inlay yarn as inlayed through every two wales of stitch rows; thus, braids for defining the mesh openings are formed by two wales stitch rows; meanwhile, the chain stitch guide bars L2, L3 and L6, L7 are knitting-width-wise shifted rightward and leftward alternately by two wales in opposite direction to each other, at pitch or cycle of predetermined number of courses, so that one of the braids is alternately joined with rightward and leftward ones of the braids. Meanwhile, the connecting yarns form a marquisette-like structure by knitting as follows; two types of connecting yarn guide bars L4, L5 are used which are in the knitting construction shown in FIG. 4, and each of which guides a full set of connecting yarns; the connecting yarns 3 are passed between the front and back mesh webs from one to the other or vise versa alternately; and simultaneously, each two of the connecting yarns 3 are shifted rightward and leftward alternately in the opposite direction to at least one wale.

By such manner of knitting, the front and back mesh webs are formed to have "net" construction comprised of polygon mesh openings such as honeycomb shaped, while the connecting yarn forms a marquisette-like structure, thereby forming a three-dimensional marquisette-like knitted fabric.

Also in such embodiment, inlay yarns thicker than the other constituent yarns may be used for at least one of the mesh webs, as to make the surface of the mesh web as uneven.

In addition, the connecting yarn for connecting the front and back mesh webs can form a marquisette-like structure by use of a two-needle stitch construction. For example, with respect to the knitting construction shown in FIG. 4 or FIG. 23, passing for guiding the connecting yarns at the connecting yarn guide bars L4 and/or L5 may be made in following manners; all passing, as well as one-in-one-out, one-in-two-out, one-in-three-out, or the combination thereof; and two-needle stitch knitting is made at all or arbitrary courses. In this way, various knitting constructions are obtainable.

Figure 24:
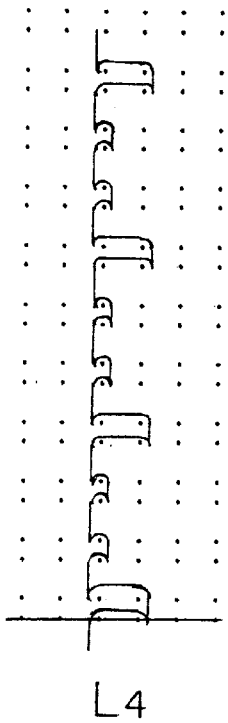
FIG. 24 is a lapping diagram showing an example of the knitting construction of constituent yarn according to an embodiment in which connecting yarn is knitted by two-needle stitch.
Figure 25:
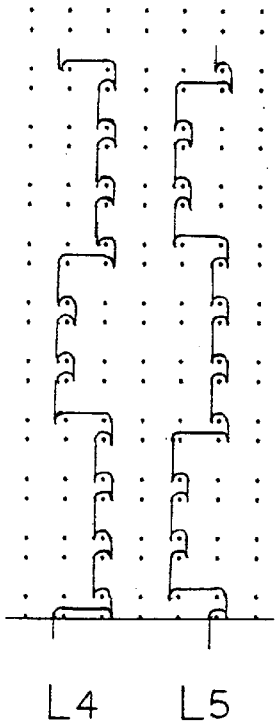
FIG. 25 is a lapping diagram showing another knitting construction of connecting yarn according to an embodiment in which connecting yarn is knitted by two-needle stitch.
Figure 26A:
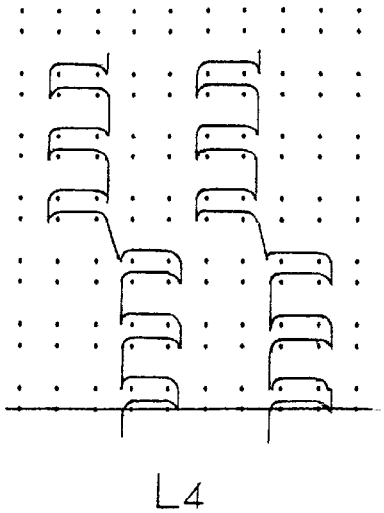
FIG. 26A is a lapping diagram showing an example of still another knitting construction of connecting yarn according to an embodiment in which connecting yarn is knitted by two-needle stitch.
Figure 26B:
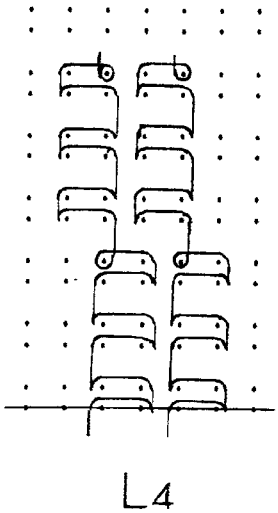
FIG. 26B is a lapping diagram showing an example of still another knitting construction of connecting yarn according to an embodiment in which connecting yarn is knitted by two-needle stitch.
Figure 26C:
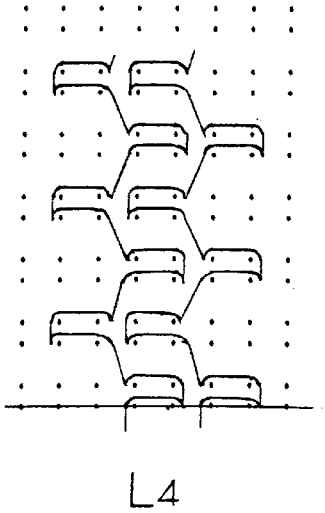
FIG. 26C is a lapping diagram showing an example of still another knitting construction of connecting yarn according to an embodiment in which connecting yarn is knitted by two-needle stitch.

The quadrangular mesh openings may be formed, for example, by repeating following operation as in FIG. 24; the connecting yarn guide bar L4, to which the connecting yarns are passed all the way through, is shifted as to shift the yarns to a respective adjacent wale by two-needle stitch, at every required number of courses. The quadrangular mesh openings may be formed, in otherwise, by repeating following operation as in FIG. 25; the connecting yarn guide bars L4, L5 of the "one-in-one-out" are shifted in the directions opposite to each other as to shift the yarns to a respective adjacent wale, at every required number of courses. Other examples of the two-needle stitched construction are shown in FIGS. 26A–26C. FIG. 26A shows the two-needle stitched construction made by the connecting yarn guide bar L4 of "one-in-three-out", while FIGS. 26B and 26C show the construction made by the connecting yarn guide bar L4 of "one-in-one-out". These constructions of two-needle stitch may be used as selected, on occasion, to fit for the applications or the objects. Needless to say, other two-needle stitch constructions may be adopted.

When connecting yarn is knitted in two-needle stitch with "all passing", the knitted fabric appears just as the plain fabric irrespective of the construction of the front and back sides, and thus the reticulated openings are not made. Therefore, it is actually preferable to adopt the construction forming marquisette-like reticulated openings as in above-mentioned examples. However, when at least one of the front and back mesh webs has a marquisette-like structure, two-needle with "all passing" and at all the courses is adoptable.

In this way, when the connecting yarns are guided to be knitted in two-needle stitch knitting, two stitch rows are firmly and unravelably connected to each other. In addition, two-needle stitch prevents the connecting yarn from appearing on the surface of the mesh web, which improves the texture and appearance of the surface of the knitted fabric. By knitting the root portion of the connecting yarn firmly into the mesh web by two stitches, stability of the three-dimensional structure and the linearity are improved. Since inlay yarns are not necessary for connecting. the wales in a plurality on mesh webs, and the stitch rows are not connected by the inlay yarn, weight per unit area is decreased; and thus the knitting speed is able to be increased, which contributes to the economic efficiency.

Moreover, because the connecting yarn is passed only once per stitch, and is knitted to be inlayed along two stitches for the front and back mesh webs to stabilize the mesh webs, light weight three-dimensional net fabric is realized with the connecting yarn uniformly distributed.

Therefore, when two-needle stitch is employed for the connecting yarn to fabricate the knitting construction shown in FIG. 24, FIG. 25, or FIG. 26A, FIG. 26B, or FIG. 26C in the three-dimensional marquisette-like knitted fabric of each of hereto mentioned embodiments, the three-dimensional marquisette-like knitted fabric with further excellent stability may be obtained.

As mentioned above, in the case where two-needle stitch is employed for the connecting yarn, the adjacent stitch rows may be gathered up or joined by the inlay yarn at the intervals of a plurality of wales on at least one of the front and back mesh webs.

In any cases of the above-mentioned embodiments, in at least one of the front and back mesh webs, the amount of supply of the chain stitch yarns or inlay yarns, the number of courses corresponding to a stitch or knitting construction may be varied at the arbitrary courses. In this arrangement, the fabric that is different in elasticity or tentering, in other words, in the cushioning effect or resiliency may be fabricated, and used conveniently for covering the chair. For example, it can be used by attaching on the seat portion of the portable chair or the like by suturing or by adhering means.

Figure 27:
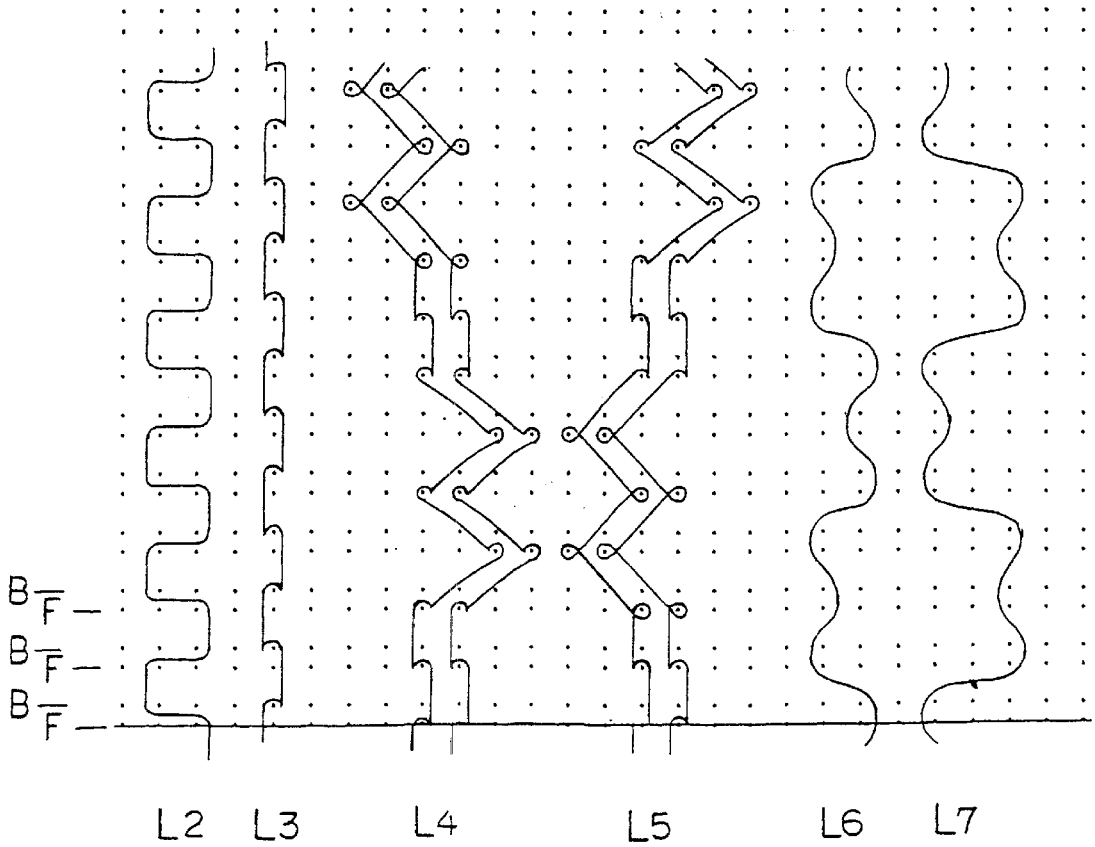
FIG. 27 is a lapping diagram of constituent yarn showing an example of still another knitting construction of the three-dimensional marquisette-like knitted fabric according to still another embodiment of the present invention.

According to the present invention, in the three-dimensional marquisette-like knitted fabric A mentioned above, different types of yarn that are different in at least one of color, material, physical property, texture, and effect of treatment may be used for constituent yarn for the front and back mesh webs. In this case, for example in the knitting construction shown in FIG. 27, the chain stitch guide bar L3 and the inlay yarn guide bars L6, L7 are used to knit the mesh web, by back needles, into a marquisette-like construction. Meanwhile, the stitch forming guide bars L4, L5 and the inlay yarn guide bar L2 are used to knit the other mesh web in a "net" construction such as a honeycomb shape, by front needles. In this operation, knitting yarns for both of the mesh webs are passed as interchanged between these mesh webs, so that both of the front and back mesh webs are connected without the connecting yarns and the yarns of the one mesh webs does not appear on the surface of the other mesh web.

In this way, for example, the back side is fabricated into a solid-touch surface in a marquisette-like construction with monofilament or polyester multi-filament; and the front side is fabricated into a soft-touch surface with multifilament processed yarn. In this way, knitted fabric products with the front and back surfaces with features different from each other, or reversible knitted products can be fabricated; which can be conveniently used especially as a cloth for covering the chair.

In the three-dimensional marquisette-like knitted fabric A according to the respective embodiments mentioned above, types of yarns for chain stitch yarns and inlay yarns for constituting the front and back mesh webs 1, 2 are not particularly limited. Whereas the types of yarn may be selected properly according to the application, various types of synthetic fiber yarns such as polyester yarns, polypropylene yarns, and nylon yarns may be used. Further, multifilament yarns, monofilament yarns, or paralleled yarns of the like of carbon fiber, glass fiber, aramid fiber, metal fiber, or other various fibers are suitably used.

Particularly, by using yarns formed of high tensile strength fibers having adequate rigidity such as above-mentioned monofilament yarns, carbon fiber yarns, glass fiber, or aramid fiber for at least a part of constituent yarn of the front and back mesh webs 1,2; a marquisette-like knitted fabric having resiliency and toughness can be obtained; and thus good in shape retainability and dimensional stability can be obtained. In addition, stability of the three-dimensional construction can be improved by; employing heat fusible yarn, entirely or partly, for constituting at least one of the front and back mesh webs; and fusing the yarn by heat setting to connect the stitches.

As a matter of course, flexible yarns may be used, such as spun yarns (twisted yarn) of synthetic fiber or of natural fiber of wool or cotton, or multifilament yarns. The flexible yarns may be used for a part or the entire portion of constituent yarn for at least one of the front and back mesh webs 1, 2. For example, relatively resilient or tough yarns such as monofilament yarns, or cotton, wool or other natural fibers are used as inlay yarns; and flexible yarns such as multifilament yarns or spun yarns of natural fiber are used as chain stitch yarns for at least one of the front and back mesh webs. As a result, the surface of the mesh web exhibits soft texture, as well as desirable shape retainability in the knitting and widthwise directions is ensured by inlay yarns. Thus, the entire fabric may have adequate resiliency and shape retainability. Even when it assumes a "net" construction having relatively large quadrangular mesh openings, the surface has soft touch and texture. It is also possible to use spun yarns or other kinds of flexible yarns for a part or the entire portion of connecting yarns, on top of using them as constituent yarns for the mesh webs. This prevent the surface from being hard even when a part of connecting yarns. are appeared on the surface; and soft touch and texture on the surface is improved. The soft and resilient double-web fabric which is different from the case where monofilament yarn is used may be obtained. Especially, by raising or shirring the surface thereof, the surface takes on further soft appearance. By employing multifilament yarn for both of the chain stitch yarn and inlay yarn of the mesh web, and further for connecting yarn, the filtering effect is increased.

It is also possible to use heat contractive yarn or elastic yarn for a part or the entire portion of constituent yarn for at least one of the front and back mesh webs 1, 2.

In this case, heat-shrink yarn or elastic yarns as mentioned above may be used also for a part or the entire portion of connecting yarn 3. Accordingly, the fabric shrinks suitably in knitting direction or widthwise direction to increase the density of yarn, thereby increasing stability. In addition, when more than two kinds of connecting yarns are used (including difference in length or thickness), tightness or unevenness effect may be increased.

By employing elastic yarns for a part or the entire portion of chain stitch yarns or inlay yarns constructing the front and back mesh webs 1, 2; a three-dimensional marquisette knitted fabric having elasticity may be obtained. In this case, fittability or resiliency that cannot be obtained in double-web without elastic yarns being utilized. Preferably, it is used for the surface of shoes or cloths because giving comfortable feelings for wearers. In addition, the type of yarns among elastic yarns, natural fiber yarns, and synthetic fiber yarns or the like may be changed at every wale or at every few wales; for establishing a three-dimensional construction having shape retainability, resiliency and soft feeling. Therefore, the fabric that is not loosened when in use can be obtained.

In addition, usable are elastic yarns such as rubber yarns and/or special elastic yarns such as polyester thermoplastic elastomer having a feature of rubber and plastic and having such a feature that it can be heat-treated and may be elongated to a certain extent, but hardly be elongated from that extent. Such elastic yarns may be used for a part or the entire portion of constituent yarn of one of the front and back mesh webs 1, 2. As a result, yarn such as synthetic fiber yarn such as high tensile strength polyester, aramid, glass fiber, carbon fiber, metal fiber may be used for constituent yarn for the marquisette-like construction on the other side. Such feature gives elasticity or flexibility to the side where the elastic yarn is used, for example to the side in other net constructions or mesh constructions such as a honeycomb shape. Such feature also gives size stability in the knitting and widthwise directions to the side where yarn of high tensile strength is used, or the side of the mesh web in a marquisette-like construction.

The three-dimensional marquisette-like knitted fabric may be suitably used for cloths, chair cover, car seat, safety protective net, bag, or bag cargo. In other words, when in use, it is elastic and comfortable, and a constant dimensional stability can be maintained. On the other hand, when it is not in use, the fabric itself may have resiliency, elasticity, and high in cushioning effect.

Connecting yarns 3 are suitably selected from synthetic fiber yarns or natural fiber yarns as in the case mentioned above considering elasticity, strength, heat contractive property, or the like so that it is suited to connect the front and back mesh webs 1, 2 into three-dimensional shape. From the standpoint of three-dimensional construction retainability, monofilament yarns are preferably used, but it is not limited thereto. For example, when it is to be soft three-dimensional construction, yarns having suitable flexibility such as twisted yarns or spun yarns may be used. These may be used not only as single yarn, but also as paralleled yarns or doubled-and-twisted or combined-and-twisted yarns.

The knitted fabric having compressive strength and soft elasticity may be obtained as a whole is obtainable by follows: yarns having suitable rigidity such as monofilament yarns are used for a part of connecting yarns 3; and monofilament yarns of different kind, thickness, and length from the one mentioned above, monofilament yarns having elasticity, or flexible yarns such as twisted yarns are used for another one part of the connecting yarns 3; the part being high compressive strength owing to rigid yarns and the part being flexible owing to flexible yarns are mixed. In addition, the fabric may have an effect of unevenness on its surfaces. This effect may be enhanced by gathering up or connecting adjacent wale stitch to fix connecting yarns. This may improve linearity of the entire knitted fabric having three-dimensional net construction.

When elastic yarns are used, cushioning effect or linearity is improved and durability thereof is enhanced.

Such types of yarns can have suitable rigidity and contraction resistance by heat setting, synthetic resin processing, or other processing. The more the number of lines and thus density of connecting yarn for connecting the front and back mesh webs, the higher the compressive strength or elasticity in the thickness direction becomes. When they are all the same quality such as nylon, the resiliency increases with its thickness. Accordingly, the surface may be uneven, which takes on good texture, thereby providing the pressure sore preventing effect.

The thickness or material of these lines of yarn are determined considering its strength, tensile strength and elasticity required for its usage. For example, as regards cushioning materials, mat materials, or industrial materials; when it is to be knitted with 14 to 9 gauge (the number of needles/inch) by double Raschel machine; yarn of 50–2000 deniers, preferably of 50–600 deniers is suitably used for the mesh web; and yarn of 30–3000 deniers, preferably of 100–1500 denier is suitably used for connecting yarn.

However, when it is desired to be knitted economically, or into a fine and soft knitted fabric, yarn thinner than yarn mentioned above may be used with finer gauge such as 28–16 gauges. While when it is desired to increase the physical strength, yarn thicker than yarn mentioned above may be used with 4.5–3 gauges, and the strength may be increased. It is also possible to use yarns of different thickness for the front and back sides.

Depending on the intended use, water absorbable yarn coated with high water absorbable resin by measures of application, kneading or dipping, or yarn adhered with or kneaded with fertilizer or metal such as iron, antibacterial agent or some other chemicals, or fungi may be used. It is also possible to stabilize the three-dimensional construction and to obtain soft texture or anti-slippage effect by coating resin or the like.

The thickness of the three-dimensional marquisette knitted fabric A and the size of the quadrangular mesh opening 4 vary depending on the application thereof. For example, when it is used as various cushioning materials, or mat materials, the fabric-of the thickness of 0.5–100 mm, and the diameter of the quadrangular mesh opening 4 of 0.5–10 mm is generally used. When it is used as vegetation net or the like, the fabric of the thickness of 3–100 mm, and the diameter of the mesh opening 4 of 3–150 mm are generally used. Of course, an embodiment outside these ranges is possible. For example, when it is used for various clothing items such as a spacer, shoes, furniture such as chair covering, or outside of the bed items, the smaller dimension may be employed. In any cases, it is preferable to set the free volume of the net to at least 70%, more preferably to at least 90% from the viewpoints of reduction of weight in terms of the thickness of the line of yarn, but it is not limited thereto depending on the application.

The three-dimensional marquisette knitted fabric A according to the present invention may be used for various purposes as shown below by utilizing its property, that is, having a three-dimensional net construction with high void contents, being superior in air and water conductibility, excellent in dimensional stability in the warp and knitting-width direction, good in shape retainability, and the effect of unevenness, cushioning effect, and high-low strength on the surface thereof.

It is used for cloths or clothing related items such as sashes, bands, bandages, tapes, supports, protectors, caps, spacers for clothing, shoulder pads, and outer wears; foot wears such as slippers, shoes, insole, sandals or the like; cushioning materials or core materials such as carpets, entrance mats, anti-friction mats, helmets or the like. In addition, it is used as core materials or surface materials for bed items or furniture such as mats for beds, pillows, sheets, covers, blankets, sofas, chair coverings; as seat materials for motor vehicles, soft cushions, air-permeable interior material, saddle cover for autobicycles or bicycles; as curtains or partitions for acoustical insulation, air ventilation or hiding; light blocking nets, anti-dazzle nets, anti-insect nets, electromagnet or static electricity preventing nets, or conductive nets, or cushioning materials for transportation. It is also used as industrial materials such as base materials for non-woven cloths, washing nets, anti-slippage materials, various filters or spacers; industrial reinforcing materials or core materials such as resin, reinforcing material for concrete form, reinforcing material for various boards such as light-weight boards and so on. In addition, it can also be used, protective materials or water retaining material for civil engineering, bank protection or afforestation, nets for agricultural use, draining material, stabilizing sheet material for civil engineering, air-permeable safety net, and so on.

Figure 28:
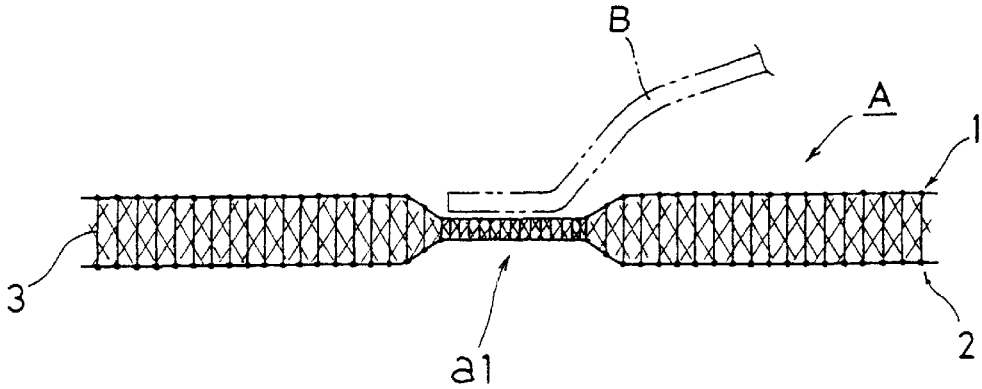
FIG. 28 is a general cross sectional view showing a part of the three-dimensional marquisette-like knitted fabric according to still another embodiment of the present invention.

In the applications mentioned above, the three-dimensional marquisette-like knitted fabric A according to the present invention may be deformed in such a manner that; the required portions are thinned by heat welding means or high-frequency vibration welding means by applying pressure and heat; or the knitted fabrics of three-dimensional construction may be welded with each other. For example, as shown in FIG. 28, by thinning and flattening a part of the three-dimensional marquisette-like knitted fabric A by welding and integrating the front and back mesh webs 1, 2, this welded portion a1 may be sewed by a sewing machine, and in addition, strength of sewing may be increased. It is also possible to attach other knitted fabric or a member B by welding means or other fastening means as well as by sewing as shown in dotted lines by the use of the welded portion a1. In such a case,the density at the welding portion a1 increases and thus the degree of deposition and strength increases by using the sheet of which the fusing point is low for the welding portion a1. In addition, adhesive agent or the like may easily be used.

According to the three dimensional marquisette-like knitted fabric A of the present invention, slip resistance materials such as rubber or synthetic resin may be attached or build up on at least one of the front and back surfaces by coating means such as dipping or application, laminating means, or some other means (not shown). In this case, when it is used for seats for various vehicles, sliding off of cushions or occupants may advantageously be prevented. In particular, it is advantageously used for saddles for autobicycles or bicycles, and seat portions of wheel chairs. In the same manner, the knitted fabric may be hardened or solidified by synthetic resin.

The three-dimensional marquisette knitted fabric of the present invention maybe used alone, or as combined construction by superimposing a plurality of these fabrics, or with sheet materials such as other net materials, knitted fabrics, pile cloths, nonwoven cloth, synthetic resin films or paper superimposed and joined by means of sewing or adhering on at least one of the surfaces thereof. The three-dimensional marquisette knitted fabric may be used as materials of composite construction by superimposing and joining the plate material of synthetic resin, wood or metal.

INDUSTRIAL APPLICABILITY

As is described thus far, the three-dimensional marquisette knitted fabric of the present invention may be suitably used for various application utilizing it features such as a net construction with high void contents, light-weight and easy-to-handle property, air and water conductibility, strong tensile strength in the knitting (warp) and knitting-width (weft) directions, excellent dimensional stability in knitting and knitting-width directions, good resiliency and toughness, and good shape retainability, and roughness on the surface.

I claim:

1. A three-dimensional knitted mesh fabric produced by warp knitting as a double-web knitted fabric, comprising:

front and back mesh webs, one of said front and back mesh webs including stitch rows each comprised of a chain stitch and an inlay yarn inlayed into said chain stitch in a zigzag pattern, at least one of said chain stitch and said inlay yarn in each of said stitch rows being shifted crosswise to a knitting direction by at least one wale at a given course position in the knitting direction such that a knitted structure having a mesh fabric having mesh openings rectangular in shape, a remaining one of said front and back mesh webs including a knitted structure with mesh openings having one of a rhombic and a honeycomb shape; and connecting yarns passed alternately between said front and back mesh webs.

2. A three-dimensional knitted mesh fabric produced by warp knitting as a double-web knitted fabric, comprising:

front and back mesh webs, one of said front and back mesh webs including stitch rows each comprised of a chain stitch and an inlay yarn inlayed into said chain stitch in a zigzag pattern, at least one of said chain stitch and said inlay yarn in each of said stitch rows being shifted crosswise to a knitting direction by at least one wale at a given course position in the knitting direction such that a knitted structure having a mesh fabric having mesh openings rectangular in shape, a remaining one of said front and back mesh webs including a knitted structure with mesh openings having one of a rhombic and a honeycomb shape, said front and back mesh webs being knitted in such a manner that yarns forming stitches in each of the front and back mesh webs are connected by being passed between the front and back mesh webs.

3. A three-dimensional knitted mesh fabric produced by warp knitting as a double-web knitted fabric, comprising:

front and back mesh webs, one of said front and back mesh webs including stitch rows each comprised of a chain stitch and an inlay yarn inlayed into said chain stitch in a zigzag pattern, at least one of said chain stitch and said inlay yarn in each of said stitch rows being shifted crosswise to a knitting direction by at least one wale at a given course position in the knitting direction such that a knitted structure having a mesh fabric having mesh openings rectangular in shape, a remaining one of said front and back mesh webs including a knitted structure with mesh openings non-rectangular in shape; and connecting yarns passed alternately between said front and back mesh webs.

4. A three-dimensional knitted mesh fabric produced by warp knitting as a double-web knitted fabric, comprising:

front and back mesh webs, one of said front and back mesh webs including stitch rows each comprised of a chain stitch and an inlay yarn inlayed into said chain stitch in a zigzag pattern, at least one of said chain stitch and said inlay yarn in each of said stitch rows being shifted crosswise to a knitting direction by at least one wale at a given course position in the knitting direction such that a knitted structure having a mesh fabric having mesh openings rectangular in shape, a remaining one of said front and back mesh webs including a knitted structure with mesh openings having a non-rectangular shape, said front and back mesh webs being knitted in such a manner that yarns forming stitches in each of the front and back mesh webs are connected by being passed between the front and back mesh webs.

5. A three-dimensional knitted mesh fabric according to claim 1 or 3, wherein the connecting yarns for connecting the front and back mesh webs are passed on a slant at every first one of required number of courses and shifted by at least one wale crosswise to the knitting direction.

6. A three-dimensional knitted mesh fabric according to claim 5, wherein shifting of the connecting yarns crosswise to the knitting direction is made at every course position corresponding to a structure of said one of the mesh webs, whereby a structure of passed portions between the front and back mesh webs is formed to correspond with the structure of said one of the mesh webs.

7. A three-dimensional knitted mesh fabric according to claim 1 or 3, wherein the connecting yams for connecting the front and back mesh webs are passed on a slant at every first one of required number of courses, to be rightward and leftward shifted crosswise to the knitting direction by at least one wale from an inter-web-wise opposed wale when being passed on the slant, whereby interweb-wise passed portions of the connecting yarns are one of slanted rightward and leftward alternately and slanted as staggered in an X shape.

8. A three-dimensional knitted mesh fabric according to claim 7, wherein, at least at a part of the front and back mesh webs, none of the connecting yarns is passed between inter-web-wise opposed wales of the stitch rows on the mesh webs.

9. A three-dimensional knitted mesh fabric according to claim 1 or 3, wherein a part of the stitch rows on at least one of the front and back mesh webs are skipped to be connected by the connecting yarns.

10. A three-dimensional knitted mesh fabric according to claim 9, wherein at least one of the front and back mesh webs is fabricated in such a manner that the stitch rows of every other or every few wales are skipped to be connected by the connecting yarns, at all course positions or at arbitrary course positions such that the stitch rows connected by the connecting yarn and the stitch rows not connected by the connecting yarn are mixed.

11. The three-dimensional knitted mesh fabric according to any one of claims 1 to 4, wherein, on said one of the mesh webs, yarns constituting the mesh webs are draw-tensioned at every first one of required number of courses, so as to make plurality of adjacent wales of the stitch rows get close to each other.

12. The three-dimensional knitted mesh fabric according to any one of claims 1 to 4, wherein said one of the mesh webs has a construction formed in a manner such that adjacent ones of the stitch rows are joined by yarns constituting very one of the mesh webs, inlay yarns being inlayed rightward and leftward alternately crosswise to the knitting direction, at every first one of required number of courses, into said adjacent ones of the stitch rows joined together.

13. The three-dimensional knitted mesh fabric according to any one of claims 1 to 4, wherein said one of the mesh webs forms a checkered pattern as a whole, as formed in a manner such that inlay yarns are rightward and leftward crosswise to the knitting direction alternately introduced at each gap between the stitch rows, and at alternately in a pitch of required number of courses.

14. The three-dimensional knitted mesh fabric according to any one of claims 1 to 4, wherein said one of the front and back mesh webs is formed in manner such that a supply rate of chain stitch yarns or inlay yarns is varied, or the number of courses corresponding to a mesh opening, or the knitting construction is varied, at every required number of courses.

15. The three-dimensional knitted mesh fabric according to any one of claims 1 to 4, wherein the front and back mesh webs are fabricated by different types of yarns in terms of at least one of color, material, physical property, texture, and effect of treatment.

16. The three-dimensional knitted mesh fabric according to any one of claims 1 to 4, wherein flexible yarns including spun yarns or multifilament yarns is employed for at least a part of yarns constituting at least one of the mesh webs.

17. The three-dimensional knitted mesh fabric according to any one of claims 1 to 4, wherein yarns having an adequate rigidity including monofilament yarns are used as a part of the connecting yarns, and flexible yarns including at least one of monofilament yarns, spun yarns, and multifilament yarns are also used as a part of the connecting yarns.

18. The three-dimensional knitted mesh fabric according to any one of claims 1 to 4, wherein elastic yarns are used, at least partly, as yarns for constituting at least one of the mesh webs and the connecting yams.

19. The three-dimensional knitted mesh fabric according to any one of claims 1 to 4, wherein yarns of high-tensile-strength fibers including at least one of mono-filament fibers, glass fibers, carbon fibers, and aramid fibers are used, at least partly, as yarns for constituting at least one of the mesh webs and/or the connecting yarns.

20. The three-dimensional knitted mesh fabric according to any one of claims 1 to 4, wherein at least one of the mesh webs has a marquisette-like construction as formed in a manner that; inlay yarns thicker than other web-constituting yarns are rightward and leftward alternately introduced as being shifted by more than one wale at every required course position.

* * * * *